US006843389B2

(12) United States Patent
Kasting et al.

(10) Patent No.: US 6,843,389 B2
(45) Date of Patent: Jan. 18, 2005

(54) SEALING MECHANISMS FOR USE IN LIQUID-STORAGE CONTAINERS

(75) Inventors: Thomas P. Kasting, Fort Wayne, IN (US); Jay E. Witte, Decatur, IN (US); Robert D. Rohr, LaOtto, IN (US)

(73) Assignee: Rieke Corporation, Auburn, IN (US)

( * ) Notice: Subject to any disclaimer, the term of this patent is extended or adjusted under 35 U.S.C. 154(b) by 103 days.

(21) Appl. No.: 10/199,618

(22) Filed: Jul. 19, 2002

(65) Prior Publication Data

US 2004/0011812 A1 Jan. 22, 2004

(51) Int. Cl.[7] ..... B67D 1/16

(52) U.S. Cl. ..... 222/111; 222/109; 222/542; 222/546; 222/569; 215/344

(58) Field of Search ..... 222/109, 111, 222/542, 546, 551, 569; 215/343, 344

(56) References Cited

U.S. PATENT DOCUMENTS

| | | | | |
|---|---|---|---|---|
| 1,632,848 A | | 6/1927 | Prahl | |
| 1,694,165 A | | 12/1928 | Debacher | |
| 3,074,579 A | * | 1/1963 | Miller | 215/344 |
| 3,275,366 A | | 9/1966 | Hidding | 294/31.2 |
| 3,856,200 A | | 12/1974 | Kramer | 220/94 |
| 4,245,753 A | | 1/1981 | Ellis | 220/288 |
| 4,399,926 A | | 8/1983 | Eidels-Dubovoy | 220/288 |
| 4,453,647 A | | 6/1984 | Neat | 220/288 |
| 4,550,862 A | | 11/1985 | Barker et al. | 222/109 |
| 4,619,373 A | | 10/1986 | Galer | 220/354 |
| 4,671,421 A | | 6/1987 | Reiber et al. | 215/228 |
| 4,673,625 A | | 6/1987 | McCartney et al. | 429/187 |
| 4,706,829 A | | 11/1987 | Li | 215/354 |
| 4,736,874 A | | 4/1988 | Durant | 222/570 |
| 4,836,419 A | * | 6/1989 | Metz et al. | 222/111 |
| 4,856,673 A | | 8/1989 | Thompson | 220/94 R |
| 4,917,270 A | * | 4/1990 | Simon | 222/111 |
| 4,974,749 A | | 12/1990 | Mon | 222/111 |
| 4,984,714 A | | 1/1991 | Sledge | 222/109 |
| 4,993,605 A | | 2/1991 | Del'Re | 222/545 |
| 5,058,772 A | | 10/1991 | Moore et al. | 222/109 |
| 5,101,993 A | * | 4/1992 | Nairn et al. | 215/232 |
| 5,108,009 A | | 4/1992 | Davidson et al. | 222/109 |
| 5,188,249 A | | 2/1993 | Cargile | 215/31 |
| 5,228,596 A | | 7/1993 | McNally | 222/109 |
| 5,234,130 A | | 8/1993 | Benioff et al. | 222/111 |
| 5,251,788 A | * | 10/1993 | Moore | 222/111 |
| 5,269,438 A | | 12/1993 | Kelsey | 220/766 |
| 5,344,041 A | | 9/1994 | Luburic et al. | 220/760 |
| 5,431,306 A | | 7/1995 | Reid | 222/111 |
| 5,435,467 A | | 7/1995 | Ekkert et al. | 222/109 |
| 5,457,850 A | | 10/1995 | Knox | 16/114 R |
| 5,462,202 A | | 10/1995 | Haffner et al. | 222/109 |
| 5,472,121 A | | 12/1995 | Silano | 222/158 |
| 5,566,862 A | | 10/1996 | Haffner et al. | 222/111 |
| 5,597,090 A | | 1/1997 | Leahy | 222/1 |
| 5,603,787 A | | 2/1997 | Reid | 156/73.1 |
| 5,624,772 A | | 4/1997 | Mc Vey et al. | 429/187 |
| 5,669,526 A | | 9/1997 | Keyfauver | 220/696 |
| 5,816,439 A | | 10/1998 | Lovell et al. | 220/760 |
| 5,855,304 A | | 1/1999 | Dean et al. | 222/481 |
| 5,941,422 A | | 8/1999 | Struble | 222/109 |
| 6,126,048 A | | 10/2000 | Bublitz | 222/570 |
| 6,209,762 B1 | | 4/2001 | Haffner et al. | 222/570 |
| 6,257,440 B1 | | 7/2001 | Perkins et al. | 220/764 |
| 6,269,949 B1 | | 8/2001 | Gottlieb | 206/519 |
| 6,269,977 B1 | | 8/2001 | Moore | 222/143 |
| 2001/0025865 A1 | | 10/2001 | Bravo et al. | 222/465.1 |

* cited by examiner

*Primary Examiner*—Kenneth Bomberg
(74) *Attorney, Agent, or Firm*—Woodard, Emhardt, Moriarty, McNett & Henry LLP

(57) ABSTRACT

A sealing mechanism for a container for sealing an interface between two or more of the structural members, including a container body, a pouring spout, and a closing cap, includes an outer annular edge formed as part of a threaded neck opening for the container body, a radial lip formed as part of the pouring spout and being positioned in contact with the neck portion and the closing cap being configured so as to be attachable to the container body for closing the opening and being constructed and arranged so as to seal against the outer annular edge when attached to the container body.

4 Claims, 23 Drawing Sheets

SEALING MECHANISMS FOR USE IN LIQUID-STORAGE CONTAINERS

BACKGROUND OF THE INVENTION

The present invention relates in general to the sealing of an interface between two (or more) members, such as between a container body and a container lid.

More specifically, the present invention relates to sealing mechanisms, structures, and techniques to be used in combination with liquid-storage containers which may be used to store (and dispense) various liquid substances such as paint, household cleaners, laundry products, and beverages, to name a few. The sealing mechanisms of the present invention may be formed portions of the actual members which define the interface to be sealed or may be separate sealing components or may be a combination of both.

In the design of liquid-storage containers, a first location to incorporate some type of sealing mechanism or structure is at the interface between the body of the container and the closing lid. Whether the lid snaps into or onto or in some fashion over the upper opening of the container neck portion, or whether the lid threads into or onto the neck, some type of sealing mechanism or gasket would likely improve the sealed integrity of that interface. Depending on the size and shape of the container and depending on the material to be placed in the container, the choice for the preferred style of sealing mechanism may change. Another factor in the selection or design of the preferred sealing mechanism or structure is the frequency of opening and closing the container.

When the liquid-storage container includes a pouring spout, additional sealing considerations come into play. How the spout is positioned in the container body will dictate to some extent what sealing mechanisms may be required and what type of sealing mechanisms or structures would be possible to employ and which types would be preferred.

The present invention focuses on various sealing mechanisms which offer a variety of design options for a variety of applications and interfaces. These various sealing mechanisms of the present invention have a general applicability for sealing between two (or more) members. However, these sealing mechanism are also described in the context of molded plastic paint containers with a screw-on lid and a pouring spout. As described, the sealing mechanisms of the present invention may be configured using shaped portions of the members which define the interface to be sealed, or may be provided by the use of separate sealing components, or may be a combination of both.

While the use of a pouring spout as part of a liquid-storage container is now commonly used for liquid laundry detergents and fabric softeners, the present invention is directed to how this broad concept can be adapted to other liquid-product containers, specifically containers for paint. While the preferred embodiment of the present invention is described in the context of a molded plastic, one-gallon paint container, the present invention is not size restrictive.

Currently used metal paint cans include a generally cylindrical can body with a circular upper opening configured with a generally U-shaped peripheral channel which captures the outer peripheral lip or protrusion of a circular lid. A wire-like metal handle is provided and hinged at opposite ends to the paint can body. Anyone who has done any painting using such a paint can is no doubt familiar with the many problems in the sense of wasted and splattered paint. The awkwardness of pouring paint from the can into a tray for a roller is also seen as a drawback with this particular design. Dipping a paint brush into the can and then using the can edge as a wiping edge also creates a mess and causes paint to be deposited in the annular U-shaped channel. As paint collects in this peripheral channel, resealing the lid becomes particularly messy as the captured paint is pushed out and may either splatter or run down the side of the paint can. Aside from the mess, the current metal paint can design results in wasted paint, not only from what drips, splatters, or runs down the side of the can, but also from not being able to tightly reseal the lid onto the can body. If the lid is not tightly resealed on the can body, the paint can dry out or skim over, causing obvious problems of continued use and often resulting in the leftover portion of paint being discarded.

By designing a paint container with a screw-on lid and a pouring spout with an excess paint drain-back feature, a number of the disadvantages with metal paint cans and the use of such cans can be eliminated. While plastic containers with spouts are now in use for laundry products, there are a number of reasons why such containers are not suitable for paint and why significant design changes must be invented to be able to create a suitable paint container with these structural features. For example, the size of the opening in the container body needs to be expanded for a paint container as compared to a liquid laundry detergent and, as such, the spout design must change. As this occurs, the sealing mechanisms or structures have to be considered. There is a desire to have a wiping edge for the paint brush as part of a suitable paint container, a factor which is not a consideration with a liquid laundry detergent. The attempt to incorporate this type of wiping edge as part of the pouring spout presents additional design challenges. The drain-back feature is also an important part of any new and improved paint container. Any paint which is wiped off of the brush or drips from the brush and any paint which might run down the lip of the pouring spout needs to have a path to reenter the body of the paint container.

A further consideration for a suitable paint container is the overall shape and balance, not only for handling and transporting convenience, including the possibility of stacking, but also for the practical consideration of being able to tint to a particular color by adding pigment to a base color, such as white. This tinting requires access to the interior of the paint container body and also requires some type of vibratory shaking of the paint container. This in turn focuses some attention on the design in terms of the size and shape of the container as well as the design of the sealing mechanisms which are employed as part of the paint container at those interfaces where leakage could conceivably occur.

The present invention provides an improvement to the current designs in this field of art in a novel an unobvious manner.

SUMMARY OF THE INVENTION

A sealing mechanism for a container for sealing an interface between a plurality of structural members according to one embodiment of the present invention comprises a first member having a neck portion defining an opening and including an outer annular edge, a second member having a radial lip positioned in contact with the neck portion, and a removable third member attachable to the first member for closing the opening and being constructed and arranged to seal against the outer annular edge when attached to the first member.

According to yet other embodiments of the present invention, various sealing mechanisms are disclosed for a container for sealing an interface between a plurality of structural members. The sealing mechanisms which are disclosed as part of the present invention preferably include as one member a molded container with a threaded neck portion, a pouring spout inserted into the neck portion of the first member, and a removable cap which is designed for threaded engagement with the spout.

One object of the present invention is to provide an improved sealing mechanism for a container.

Related objects and advantages of the present invention will be apparent from the following description.

DESCRIPTION OF THE PREFERRED EMBODIMENTS

Figure 1:
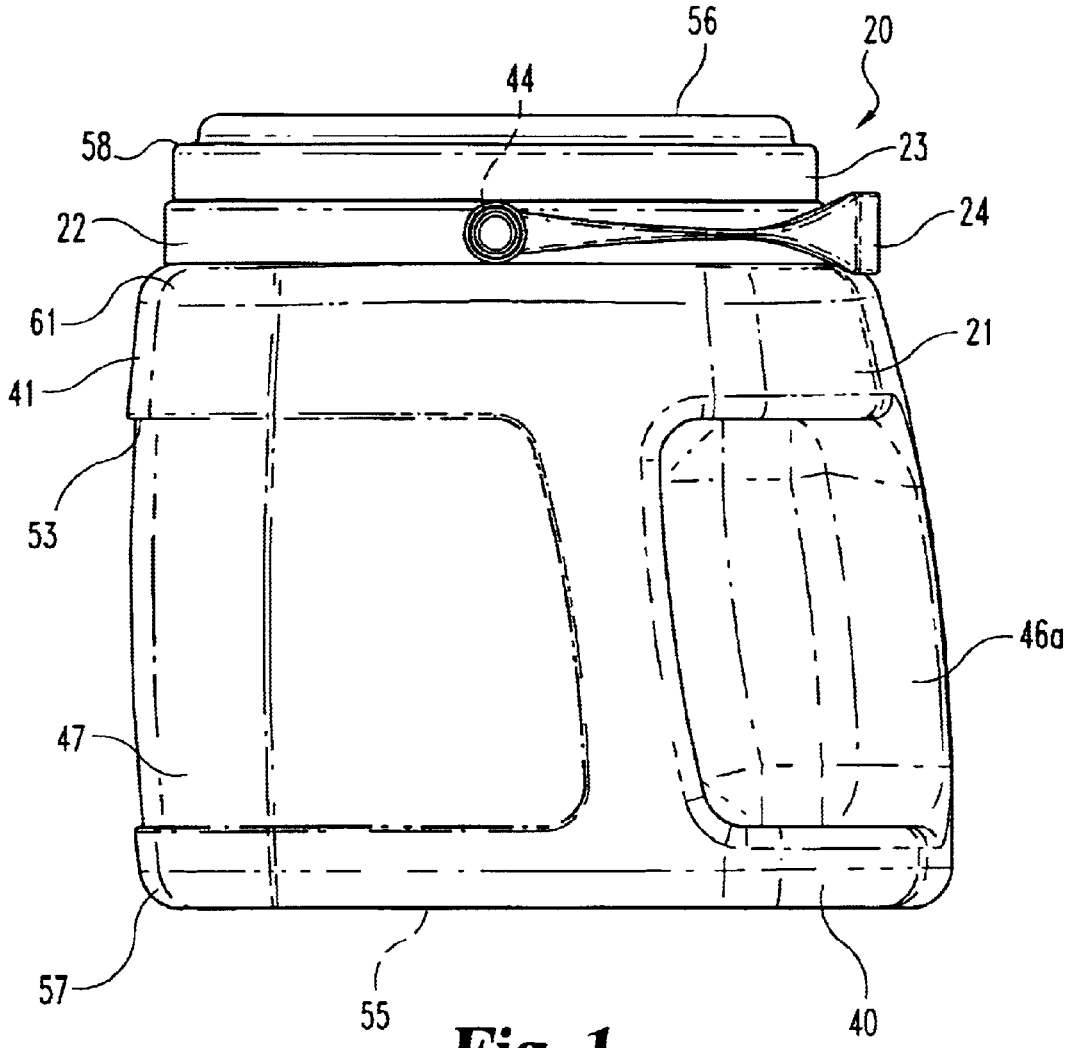
FIG. 1 is a right side elevational view of a paint container according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates to the design and construction of various sealing mechanisms and these are described in combination with various containers, preferably a molded plastic paint container with a pouring spout.

Referring to FIGS. 1, 2, 3, 4, and 5, there is illustrated a molded plastic paint container 20 according to a representative example for use with the preferred embodiments of the present invention.

Referring to FIGS. 1, 2, 3, 4, and 5, there is illustrated a molded plastic paint container 20 according to one embodiment of the present invention. Paint container 20 includes a contoured body 21, pouring spout 22, and threaded lid or cap 23. A hinged, bail-like handle 24 is attached to the pouring spout 22. In the illustrated embodiment, the spout 22 includes a lower threaded portion 25 which threads onto the neck portion 26 of body 21 and an upper threaded portion 27 to which the cap 23 is threaded.

Figure 6:
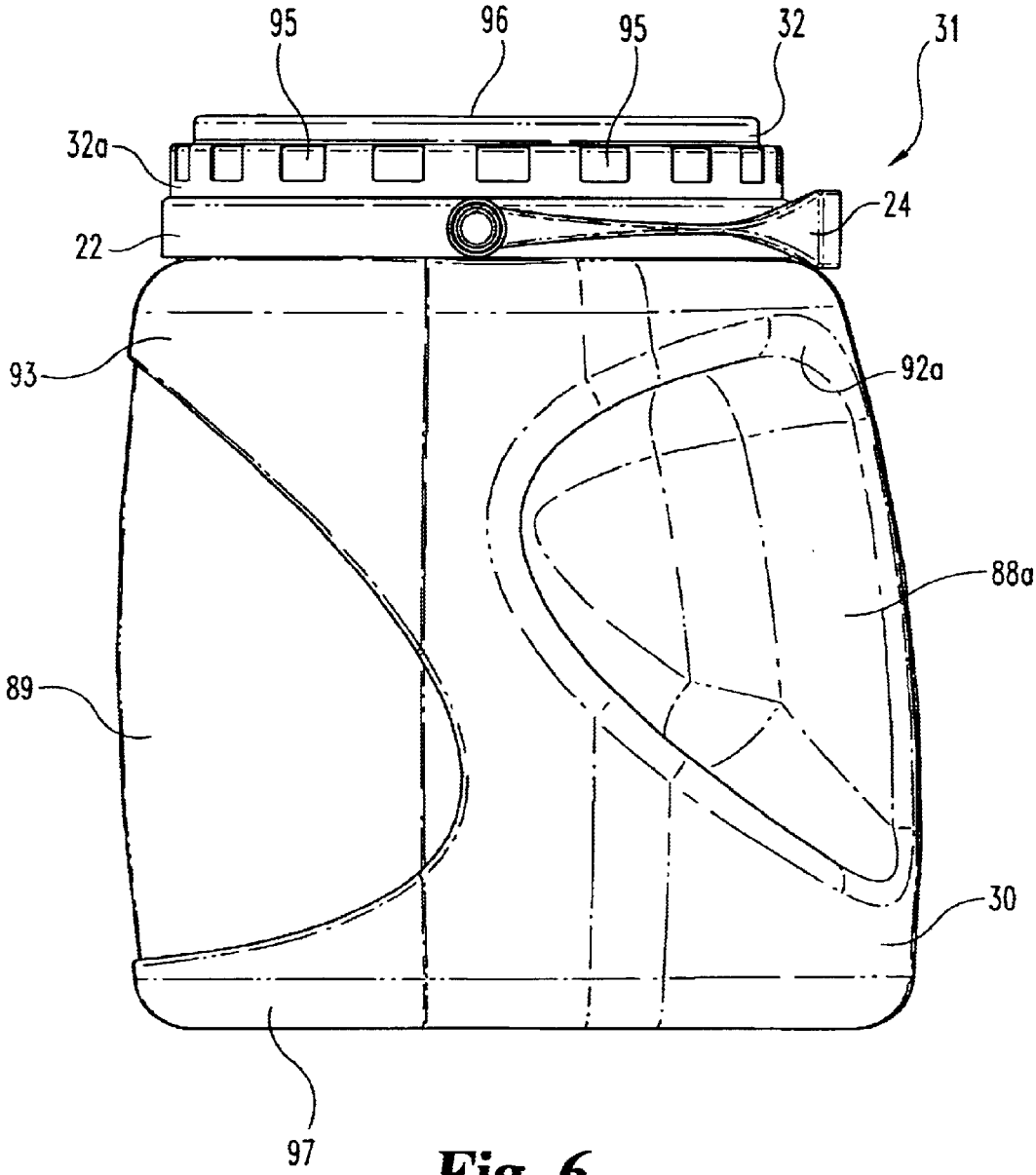
FIG. 6 is a right side elevational view of a paint container according to another embodiment of the present invention.
Figure 7:
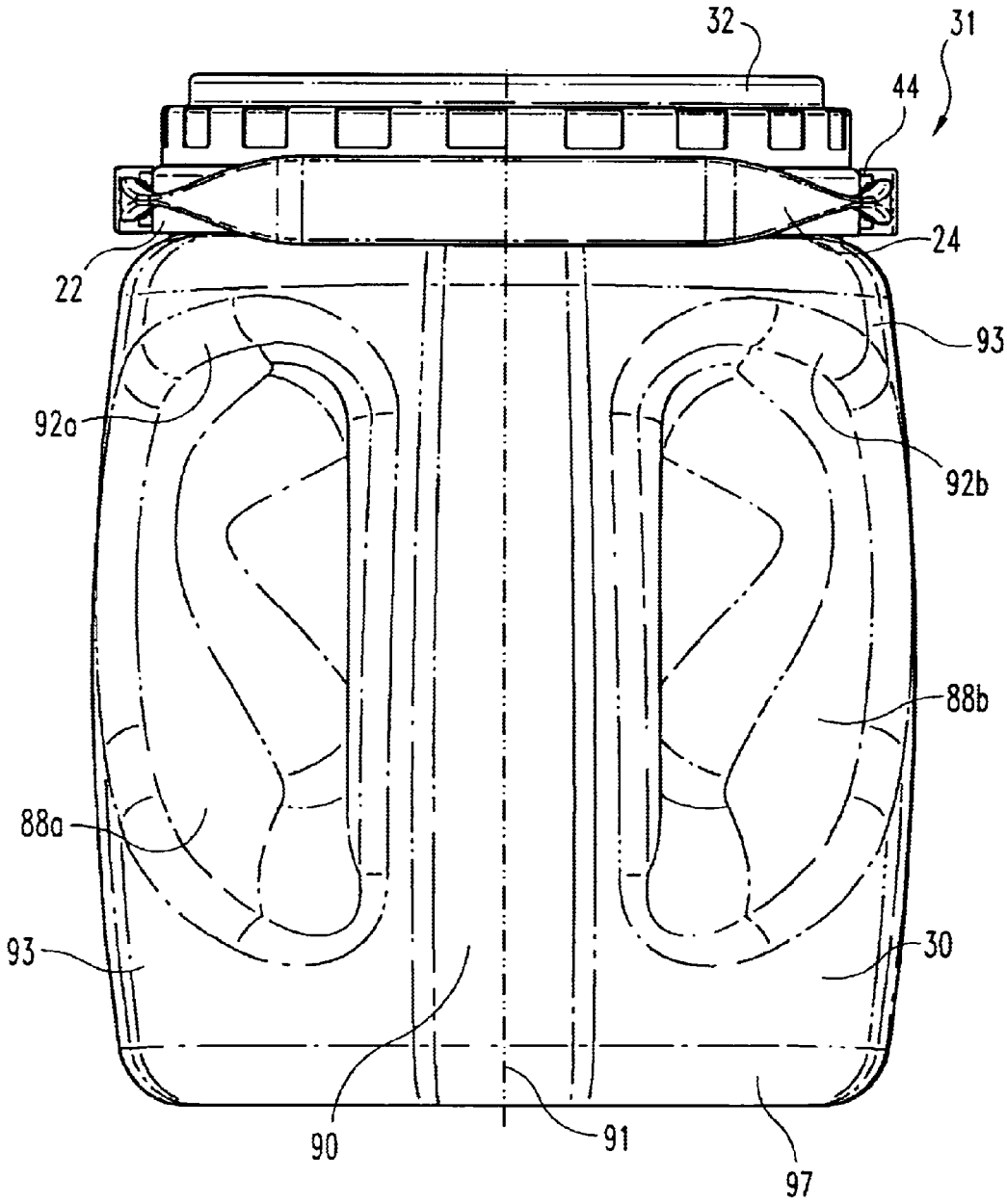
FIG. 7 is a rear elevational view of the FIG. 6 paint container.
Figure 8:
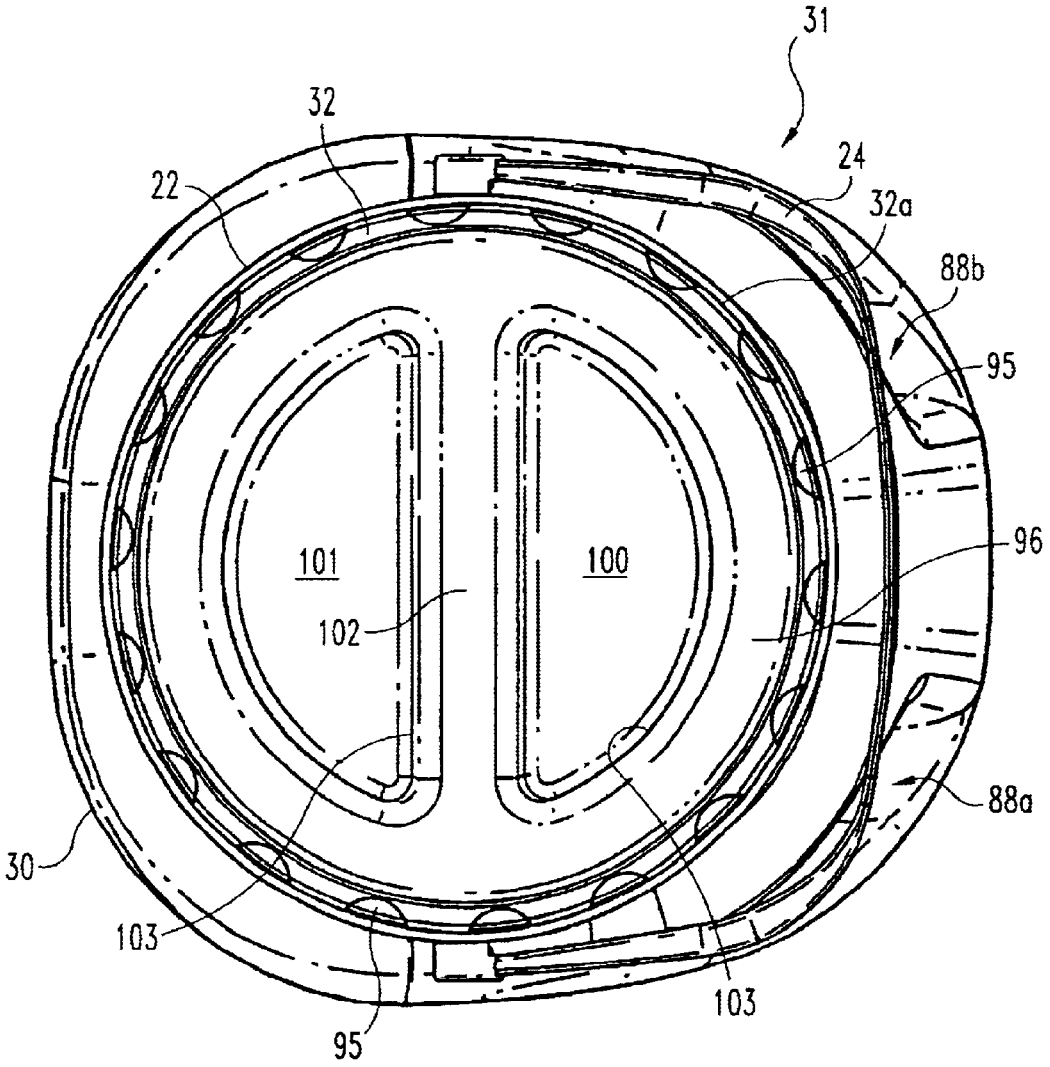
FIG. 8 is a top plan view of the FIG. 6 paint container.
Figure 9:
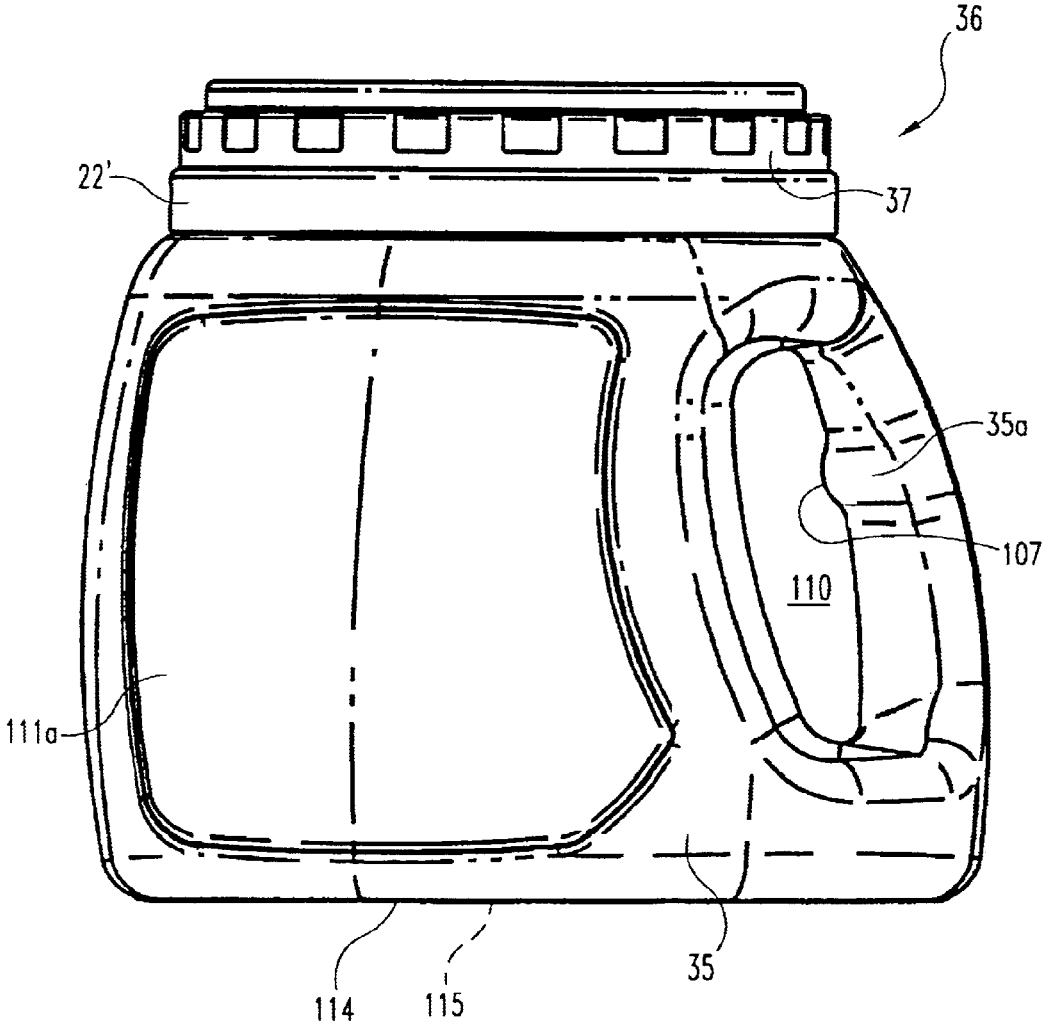
FIG. 9 is right side elevational view of a paint container according to another embodiment of the present invention.
Figure 10:
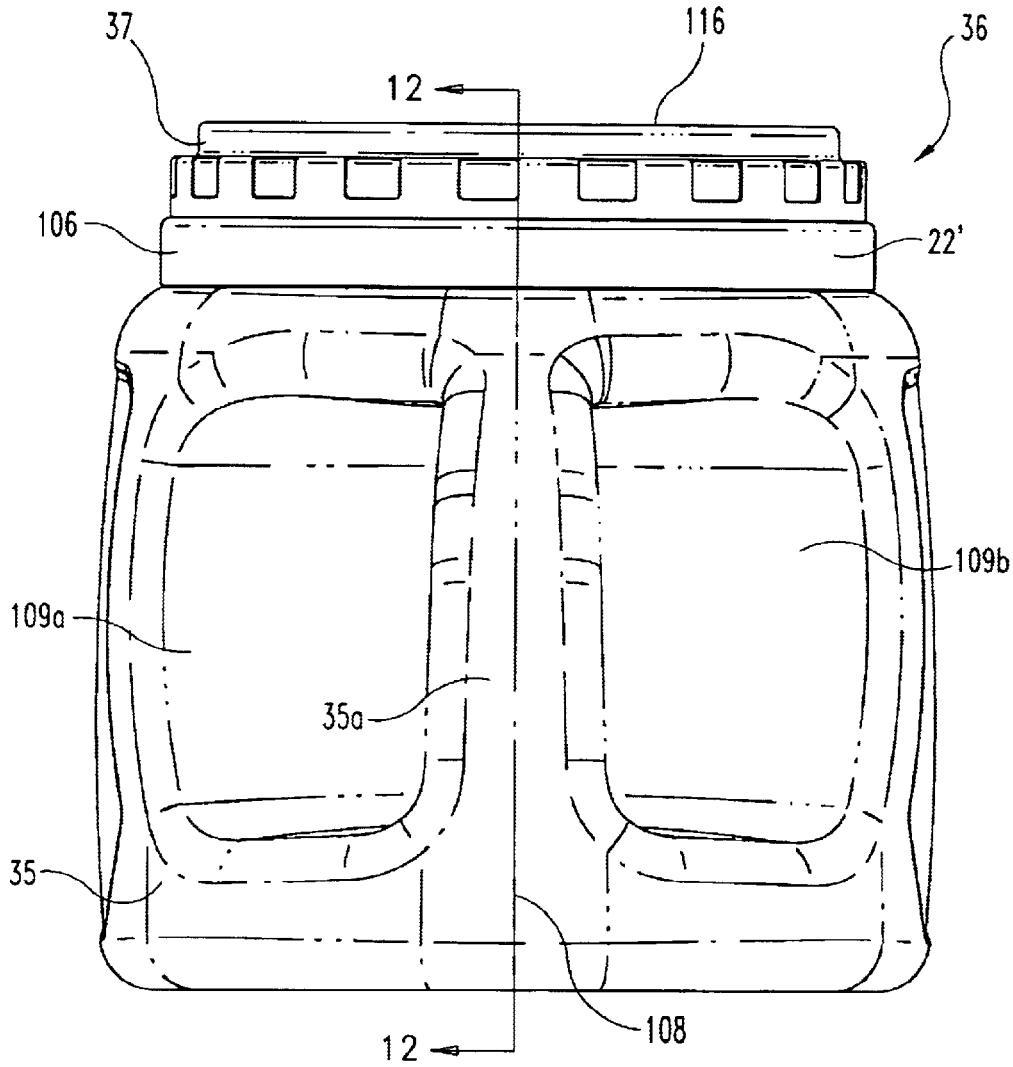
FIG. 10 is a rear elevational view of the FIG. 9 paint container.
Figure 11:
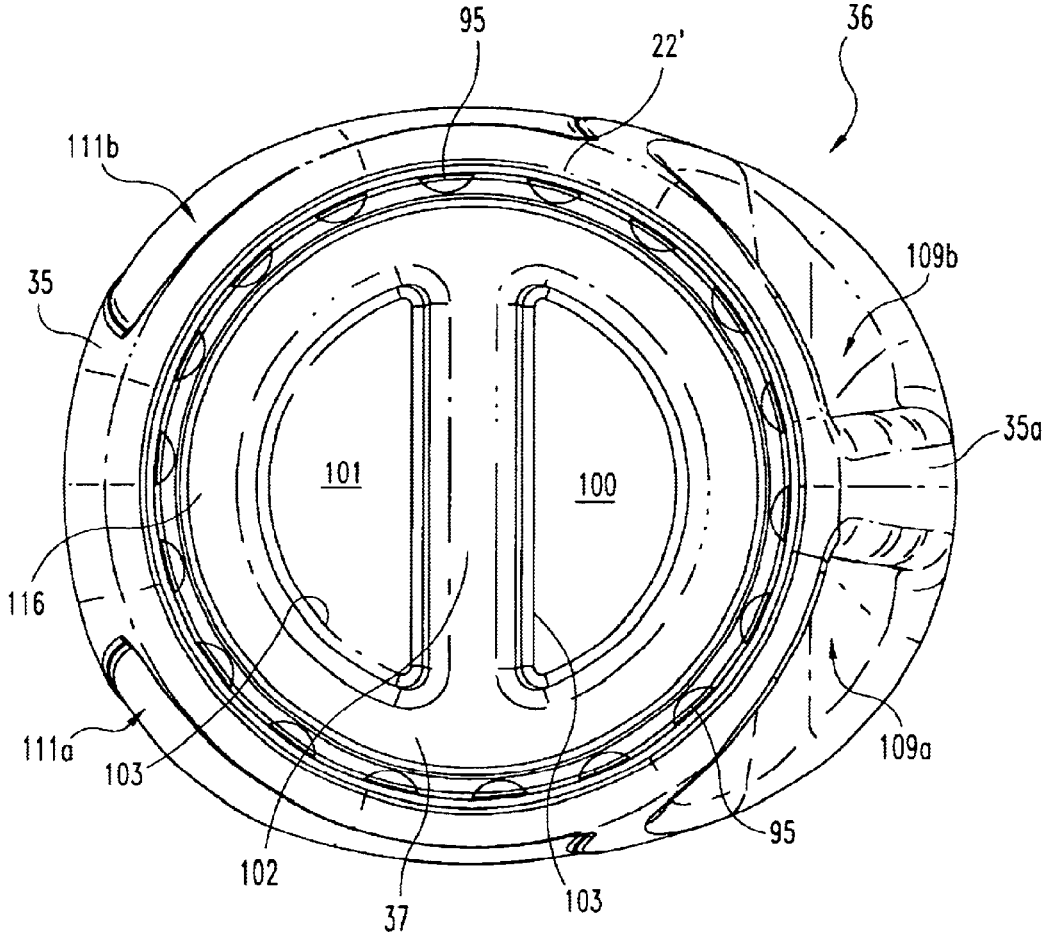
FIG. 11 is a top plan view of the FIG. 9 paint container.
Figure 12:
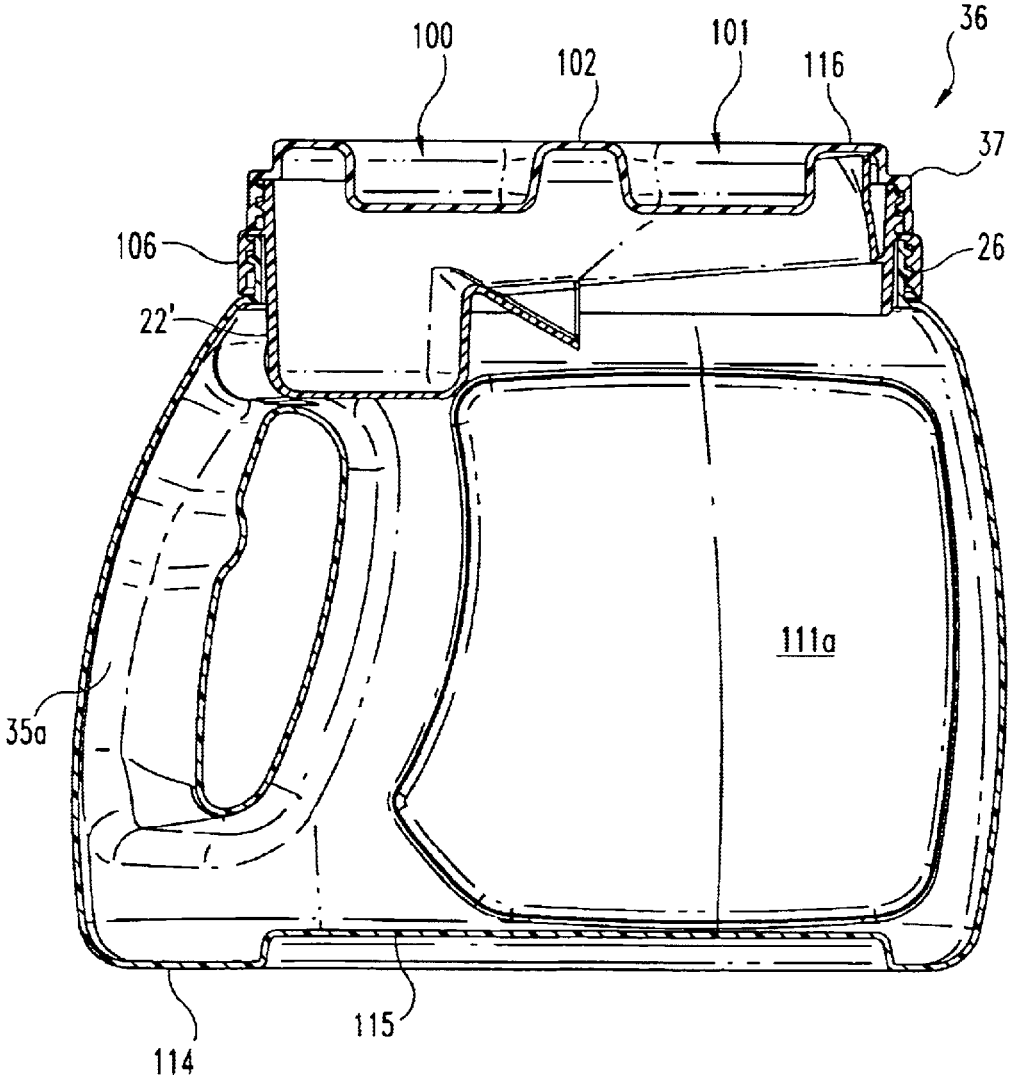
FIG. 12 is a left side elevational view, in full section, of the FIG. 9 paint container as viewed along line 12—12 in FIG. 10.

FIGS. 6, 7, and 8 illustrate a second configuration for the contoured body 30 of paint container 31 and a second configuration for the cooperating cap 32. The spout and handle which are used in container 31 are identical to spout 22 and handle 24. The only difference between these first and second paint container designs resides in the shape and contouring of the container body and in the shape and contouring of the cooperating cap.

Figure 13:
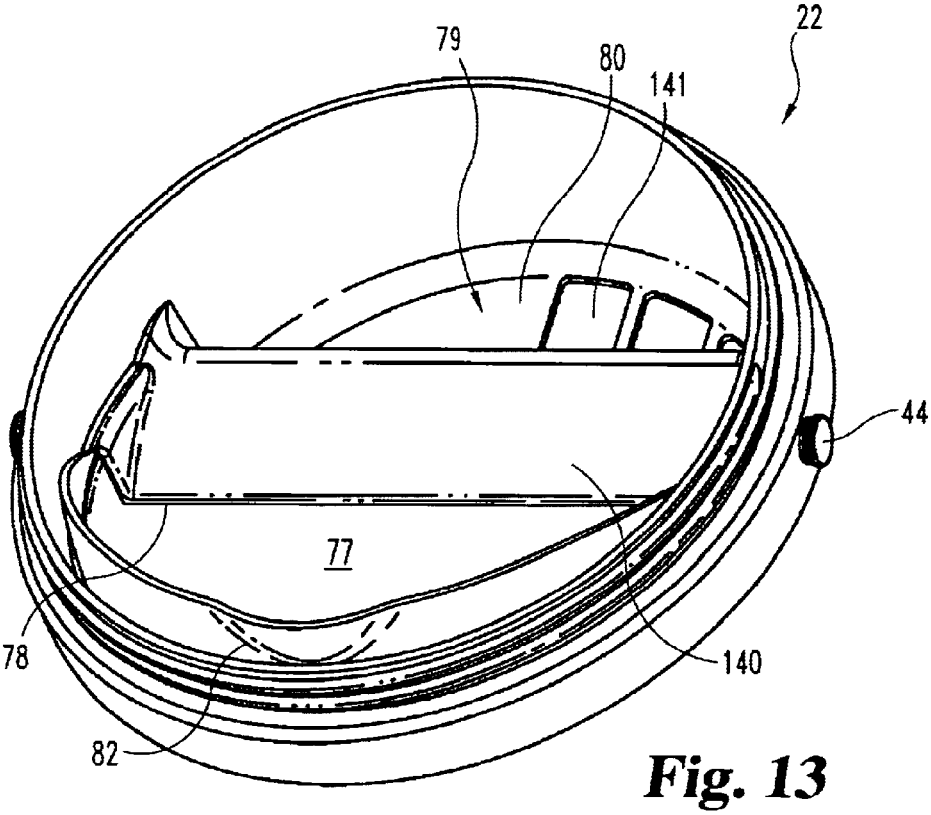
FIG. 13 is a perspective view of the spout of the FIG. 1 and FIG. 6 paint containers.
Figure 14:
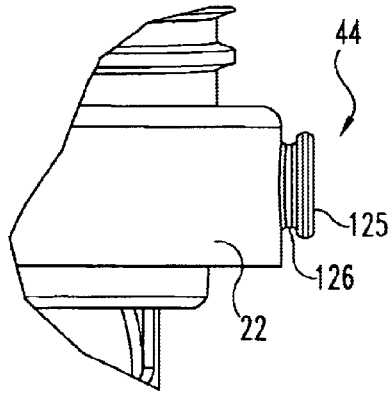
FIG. 14 is a partial, front elevational view of a pivot post comprising one portion of the FIG. 13 spout.
Figure 15:
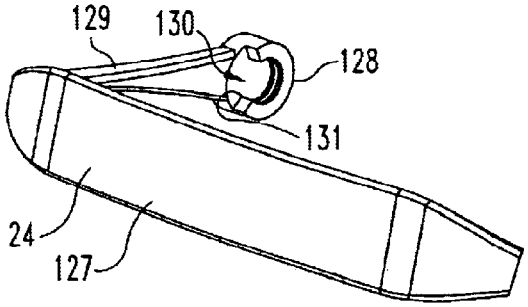
FIG. 15 is a partial perspective view of the handle of the FIG. 1 and FIG. 6 paint containers.

Referring to FIGS. 9, 10, 11, and 12, a third configuration for the contoured body 35 of paint container 36 is illustrated. Included is a third configuration for the cooperating cap, though in many respects cap 37 is similar to cap 32. The spout 22' which is used in container 36 is substantially identical to spout 22. However, due to the molded-in handle 35*a* as part of the contoured body 35, a separate handle 24, as might be hinged to the spout 22, is not included. Accordingly, the spout of the FIGS. 9–12 embodiment has been referenced as 22' to reflect the design change to omit the two pivot posts for handle 24. Other differences between the first, second and third paint container designs reside in the shape and contouring of the container body and the shape and contouring of the cooperating cap. Additionally, the third paint container design omits the hinged, bail-like handle 24 from spout 22' in exchange for the molded-in handle 35*a*. Additional details of spout 22 (and in part spout 22') are illustrated in FIGS. 13 and 14 and these drawings should be referred to for a more complete understanding of the paint container 20 of FIGS. 1–5. These spout details are also part of paint containers 31 and 36. Similarly, additional details of the handle 24 and its connection to the pivot posts of spout 22 are illustrated in FIGS. 14 and 15 and these drawings should be referred to for a more complete understanding of the paint container 20 of FIGS. 1–5. These handle details are also part of paint container 31.

With continued reference to FIGS. 1–5, paint container 20 is a molded plastic container with a contoured body 21 sized to hold approximately, but at least, one gallon of paint within the defined interior volume. The contoured body 21 includes a base 40, sidewall 41, and a series of external threads 42 on neck portion 26 which defines a circular opening 43. The circular opening 43 provides the means to initially fill the container 20 with paint. Thereafter, the spout 22, handle 24, and cap 23 are attached to securely close the circular opening 43 and thus securely close paint container 20. It is envisioned that the internally-threaded cap 23, via threaded outer wall 23*a*, will be threaded onto the upper threaded portion 27 of the spout and that the handle 24 will be attached to the spout, by means of two pivot posts 44, before threading the spout to the neck portion 26 by way of threads 42. In this way the cap, spout, and handle can be preassembled as a cap subassembly and attached as a single subassembly unit directly to the contoured body 21 as the lower threaded portion 25 of the spout 22 threads onto the neck portion 26 of the contoured body 21.

If the initial fill of paint is of the final color or tint which is desired, such that it is ready to be used as initially packaged, then the preassembled subassembly of the cap 23, spout 22, and handle 24, would not need to be removed from the contoured body 21 prior to first use. The purchaser/end user would then merely unscrew the cap 23 in order to gain access to the paint. However, if the initial fill of paint is a base color or tint which is going to be further colored or tinted by the addition of other pigment, then the store personnel would typically remove the preassembled subassembly of the cap 23, spout 22, and handle 24 in order to gain access to the paint in the body 21 in order to add the required pigment to create the selected color. After adding the pigment, the container body 21 is closed by (re)attaching the spout 22 to the neck portion 26, while the cap and handle remain assembled to the spout. The paint mixture is then blended by a vibratory shaking process. One advantage of attaching the transporting handle 24 directly to an exterior wall surface of the spout is to simplify the container body 21 design. The handle 24 in this location does not interfere with the equipment for the vibratory shaking process. Also, by raising the handle pivot location to an upper location as compared to the body of the container, the balance of the container when dispensing paint is improved.

In describing the interior volume of contoured body 21 as being designed to hold at least one gallon of paint, two important points need to be made. First, the details of the present invention are not size restrictive nor size limited. Whether considering the inventive features relating to the container structure or the inventive features relating to the various sealing mechanisms, the present invention details can be incorporated into virtually any size of container which can be used for virtually any type of product, most likely a liquid product. A one-gallon paint container was selected as the preferred embodiment to be used to describe the container structure and to describe the various sealing mechanisms disclosed herein and comprising part of the present invention. In this context, the purchaser/end user expects to receive at least one gallon of paint since that is how the package is marked and that is what is advertised. Secondly, some clearance space (air volume) is required inside of the closed container after it is initially filled with paint so that there will be some space left in order to permit movement of the paint during any vibratory mixing. Further, space needs to be provided so that if pigment is added, there is space to do so while still having some clearance space left so that the vibratory mixing can be performed in order to blend the added pigment into the base paint color.

Figure 2:
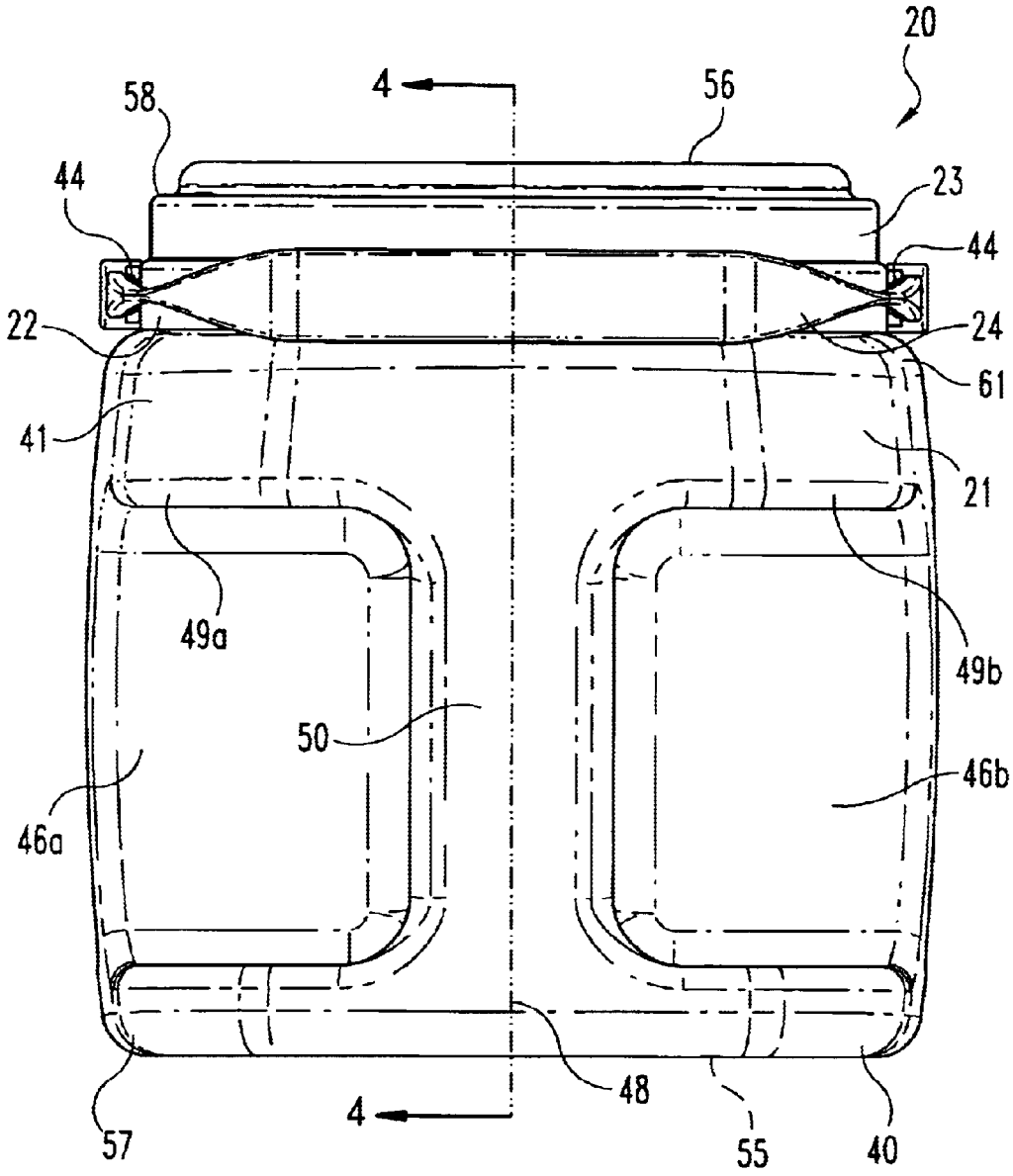
FIG. 2 is a rear elevational view of the FIG. 1 paint container.

Continuing with FIGS. 1–5, contoured body 21 includes three recessed portions 46*a*, 46*b*, and 47. The size, shape, and location of these three recessed portions are important in view of their described functions. Portions 46*a* and 46*b* are best illustrated in FIG. 2 and are seen as being virtually identical to each other and symmetrically positioned on opposite sides of contoured body centerline 48. The depth of each recessed portion 46*a* and 46*b* is approximately ½ inch at its deepest location, noting that there is a smooth and gradual transition by means of the rounded peripheral edges 49*a* and 49*b* which connect the interior of portions 46*a* and 46*b*, respectively, to the outer surface of sidewall 41.

The area of each recessed portion 46*a* and 46*b*, as well as the depth of each portion, is adequate for the fingers on one side and the thumb on the other side of the end user to be placed on opposite sides of land portion 50 for gripping of the contoured body via land portion 50, to assist in pouring paint from the body 21 by way of spout 22. The symmetrical design and the virtually identical configuration of portions 46*a* and 46*b* allows the paint container to be used in an equally convenient manner by both right-handed and left-handed end users.

It should also be noted that centerline 48 is the lateral centerline for handle 24 and for spout 22, especially the pouring lip portion of spout 22 which will be described in greater detail later. In this way, the container 20 can be lifted by the handle 24 by one hand and the body gripped by the other hand for tilting the body, with the cap 23 removed, in order to pour out paint by way of the pouring spout. Since the handle is attached to the spout as opposed to the container body, it moves the handle support line location closer to the pouring location and this yields better control and balance. If done correctly, the pouring paint is not able to contact any part of the handle and this lessens any spillage or mess. Further, there is an ergonomic balance and convenience to this method of use and container manipulation in view of the way the hands of the end user are positioned relative to the container body (land portion 50) and relative to the handle 24. This enables a more controlled dispensing of the paint, not only due to the addition of the pouring spout, but also due to the design of the handle, the design of the contoured body, and the centerline positioning of these structural features. The recessed portions 46*a* and 46*b* provide the necessary clearance for the hand of the end user to be able to grip around land portion 50 as part of the overall handling and manipulation of the container 20.

Recessed portion 47 is continuous from one side of contoured body 21 to a corresponding location on the opposite side such that portion 47 is substantially symmetrical, in size, shape and location, relative to centerline 48 and effectively located opposite to portions 46*a* and 46*b*. As will be noted from the edge views, the depth of portion 47 is relatively shallow, approximately 1/16 inch in depth, and is generally uniform throughout and is separated from the outer surface of sidewall 41 by a substantially flat, lateral peripheral edge 53 which surrounds and helps to define recessed portion 47. This recessed portion 47 is used to receive a product label. Whether the product label is applied by adhesive or some other technique, possibly a molded-in-place design to be described later, the label thickness is such that it fits within recessed portion 47 below the outer surface of sidewall 41. In this way, by actually recessing the label in portion 47, the outer peripheral edge 53 which surrounds the label protects and guards the peripheral edge of the label such that the label edge will not be caught or contacted in such a way that the label might either tear or begin to peel off from the container.

The base 40 is contoured with a recessed circular portion 55 which is sized, shaped, and positioned so as to be compatible with the size, shape and position of raised portion 56 of cap 23. In this way, it is possible to safely stack one paint container 20 on top of another, similarly styled paint container 20. Although the raised portion 56 is uniquely contoured for easier gripping of cap 23, the outer peripheral shape is part cylindrical and is capable of being inserted into a cylindrical recess, so long as the cylindrical recess is slightly larger and slightly deeper. By sizing the recessed circular portion 55 in this manner, the outer portion 57 of base 40 that surrounds recessed circular portion 55 then actually rests on the radial collar 58 of cap 23 so as to give added support to the weight of the upper paint container. The stack of two or more paint containers 20 thus utilizes the interfit of portion 56 into portion 55 to help steady and stabilize the stacked combination.

The contoured body 21 extends above the recessed portions 46*a*, 46*b*, and 47 into a curved portion 61 extending around the periphery of the upper part of the contoured body 21. The curved portion 61 then extends inwardly in a radial direction, at which point it joins neck portion 26. The neck portion 26 is annular with a substantially cylindrical inner surface 62, terminating at top edge 63 which is substantially flat but which includes a slight unevenness and slight surface irregularities due to the molding process. Top edge 63 defines circular opening 43. The exterior of the neck portion 26 is externally threaded with threads 42. With added reference to FIG. 3, the overall outer shape of body 21 includes four sides for sidewall 41 and the rounded "corners" 64*a*–64*d* between adjacent sides 65*a*–65*d*. This top plan view also helps to illustrate the location of land portion 50 as well as the contoured and tapered sides of the land portion 50 which helps (ergonomically) with the comfort of the grip by the hand of the user.

Figure 3:
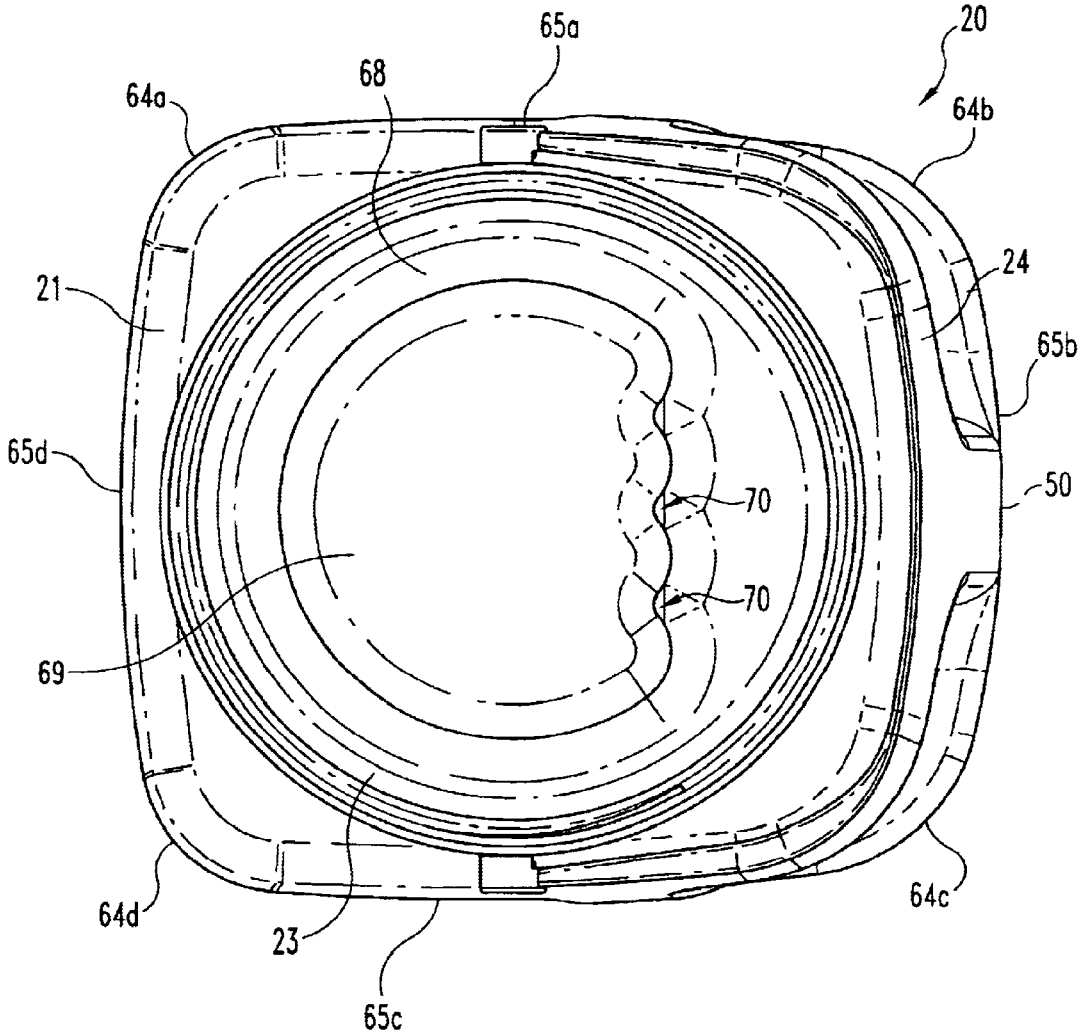
FIG. 3 is a top plan view of the FIG. 1 paint container.

With continued reference to FIG. 3, it will be seen that the interior region of the top surface of cap 23 is recessed with an annular channel 68 which surrounds a gripping island 69 which is shaped with a series of three finger recesses 70 used to receive the first three fingers of the end user's hand for opening and closing the paint container by unscrewing (opening) the cap and by screwing the cap back in place in order to close the container. Since container 20 is designed for paint and since this suggests the value of a large opening in the neck portion, i.e., circular opening 43, the ergonomics of opening and closing the container by removing and reapplying the cap must be factored into the final design. Recognizing that the outside diameter size of cap 23 is approximately 6-3/16 inches, it is awkward to try and unscrew the cap from a tightly closed container with only one hand. Using two hands to grip a larger diameter cap precludes the ability to also hold the container body stationary with the other hand. The awkwardness of trying to single-handedly manipulate a larger diameter cap exists whether the cap is being removed or is being reapplied. In order to help solve this problem, as provided by this embodiment of the present invention, cap 23 is contoured with a smaller gripping portion in the form of gripping island 69. Additionally, land portion 50 is provided and is able to be held with one hand when unscrewing the cap (and reapplying it) in order to hold the contoured body 21 relatively stationary. The other hand grasps gripping island 69 and uses finger recesses 70 to manipulate the cap 23.

Figure 4:
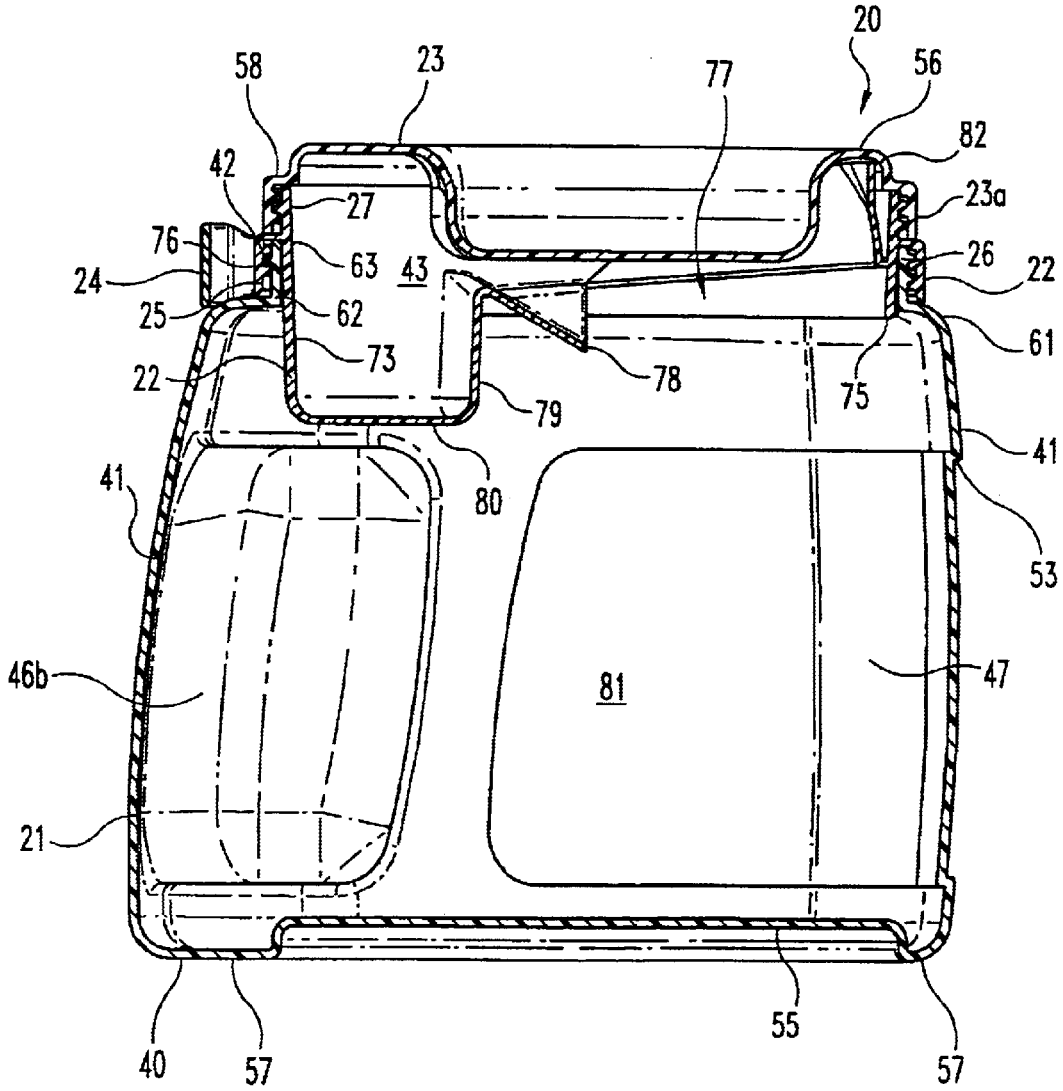
FIG. 4 is a left side elevational view, in full section, of the FIG. 1 paint container as viewed along line 4—4 in FIG. 2.
Figure 5:
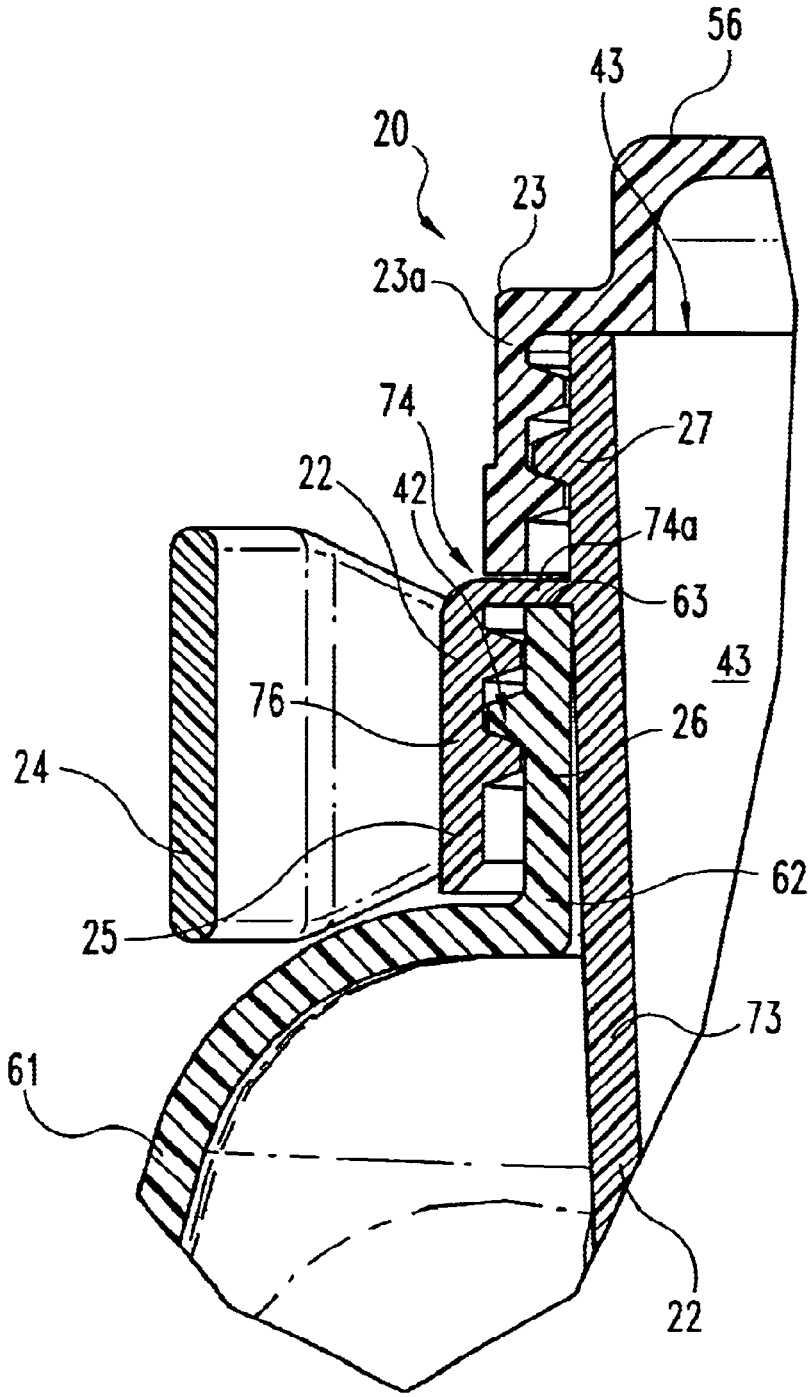
FIG. 5 is a partial, enlarged detail view, in full section, of the spout connection of the FIG. 1 paint container.

Although the pouring spout 22 will be described in greater detail later, a few brief remarks are appropriate here in the context of generally describing paint container 20. The pouring spout 22 includes an annular sidewall 73 which is slightly tapered in its lower portion, leading away from annular collar 74 in a downward axial direction toward lower edge 75. The exterior surface of sidewall 73 above collar 74 provides the upper threaded portion 27. The outer annular wall 76, depending from the radial wall 74*a* of collar 74, is internally threaded and provides the lower threaded portion 25. The pouring spout includes an interior opening 77, a wiping edge 78, and a brush receptacle 79 which defines a series of apertures in bottom wall 80 for the drain-back of surplus paint into the interior volume 81 of the contoured body 21. The pouring lip 82 is positioned opposite to the brush receptacle 79 and extends in an upwardly direction as illustrated in FIG. 4.

By sizing the annular sidewall 73 with a gradual taper and with an interference fit relative to inner surface 62 at an upper location adjacent collar 74, a sealed interface by means of this interference fit can be created between spout 22 and neck portion 26 of the contoured body. This interference fit also helps secure the pouring spout 22 within the neck portion 26 of container 21. By having an interference fit, there is less tendency for the spout to back off of or out of the threaded engagement to the neck portion 26. The threading of the spout onto the neck portion 26 begins with what can best be described as interference free fit due to the taper adjacent lower edge 75. However, as the threaded advancement continues, an interference fit gradually begins to occur. The threading of the spout onto the neck portion continues until the top edge of the neck portion seats against the underside surface of the radial wall 74*a*. As the threaded advancement occurs, the degree of interference between sidewall 73 and inner surface 62 progressively becomes tighter and tighter in an effort to try and achieve or facilitate achieving a sealed interface at that location between the two members. This interference fit is also intended to help hold the spout 22 in position in the container body 21 while cap 23 is removed and reapplied.

Sealing of the interface between the spout 22 and neck portion 26 can be provided by the interference fit between sidewall 73 and inner surface 62, or at the interface between the radial wall 74*a* of collar 74 and top edge 63 of the neck portion, or at both locations. While the achievement of suitable sealing can be attempted by merely surface-to-surface contact, the degree of tightness of the fit and the force required for tightly screwing the spout onto the neck, can be a consideration. To lessen the reliance on only the surface-to-surface contact between these two members, one or more sealing mechanisms can be incorporated into the design of paint container 20. Since many of the sealing mechanisms or structures disclosed herein as part of the present invention can be used in cooperation with other types of containers and enclosures, these sealing structures are disclosed in a more generic form relative to the two (or more) corresponding members which define the interface to be sealed. More specifically, the structural members which are disclosed generically represent any two (or more) structural members which have an interface where some degree of sealing is desired. In the context of the preferred paint container embodiments of the present invention, one interface for sealing is between the spout and the contoured body.

Another interface to be sealed is between the spout and the cap. It would also be possible to consider a secondary seal between the cap 23 and the collar 74 of the spout 22, as a back up if the primary spout-to-cap sealed interface would be prone to exhibit leakage. While the preferred embodiments of the sealing mechanisms of the present invention utilize formed portions of the members which define the interface to be sealed, other techniques can be used, such as the use of separate sealing components or a combination of formed portions and separate components.

As should be understood, paint container 20 is generally symmetrical about centerline 48 and thus includes the associated component parts. The spout 22 includes a pouring lip 82 which is centered on centerline 48, while the handle 24, land portion 50, and recessed portion 49 are also entered in centerline 48. The centerline alignment of the various portions and components of paint containers 20, 31, and 36 is important for several reasons. From the standpoint of stacking and arranging the paint containers on a store shelf, it is preferable to have some uniformity as to the location or orientation of handle 24 and preferably to have it centered on the sides of the container so that the product label in the front is unobstructed. The threading of the spout is also an important consideration as a way to properly orient the spout relative to the corresponding container body with a minimum of handling machinery complexity.

When lifting and tilting the paint container in order to pour out an amount of paint, the centerline of the pouring lip 82 is preferably coincident with the centerline of handle 24 and with the centerline of land portion 50 or alternatively the molded-in handle 35*a*. While the unitary construction of spout 22 (or spout 22') can guarantee pouring lip 82 and handle 24 alignment, their centerline alignment to land portion 50 or handle 35*a* depends on the position of the spout 22 within the container body 21. If a spout is merely inserted into a container neck portion without any specific detents, indentations, keys, or some other indexing means to guarantee proper alignment, then the handling machinery which is used to deliver the various components to the installation location and the machinery used to actually install one component into the other must be arranged in some manner so as to either recognize and then orient the components in the proper alignment prior to assembly or deliver the components to the assembly location in the properly aligned orientation.

In contrast, the present invention uses the threaded engagement between the spout 22 and neck portion 26 as well as the configuration of the threads on the neck portion and/or the configuration of the threads on the spout in order to guarantee the desired centerline alignment. The circumferential starting location for the threaded engagement can be controlled based on the mold design for the container neck portion and/or based on the mold design for the spout. The thread pitch and thread length can also be controlled and effectively these can be used to control the number of turns or revolutions of the spout 22 as it threads onto the neck portion 26. A fixed position stop can also be used as part of one or both sets of threads to precisely control where the threading of the spout onto the neck portion will stop. Given the starting location of threaded engagement, the number of turns or revolutions or fractions thereof, and the precise stopping location, it is possible to guarantee centerline alignment between the pouring lip 82 and land portion 50. In practical terms, with any type of automated filling and capping procedure, the container body will be provided in an upright orientation with the cap, spout, and handle removed. Paint is then added to the interior volume and the container body moves down the assembly line to the location where the cap, spout, and handle subassembly will be assembled. Regardless of how the container body might be turned at the point where the spout is to be assembled and to some extent regardless of how the spout might be rotated or turned when it is lowered into engagement with the neck portion, threaded engagement will begin at a precise location and the number of turns or portions thereof prior to stopping the threaded engagement will enable the spout to be assembled to the neck portion such that the centerline of the pouring lip 82 is coincident with the centerline of land portion 50 or handle 35*a*.

While paint container 20 and the other two paint container embodiments disclosed herein are not illustrated with any specific sealing mechanisms or structures, this was done to create a more generic container structure. It should be understood that one or more of those sealing mechanism embodiments disclosed herein can be used and preferably will be used as part of container 20 when container 20 is used for a liquid such as paint. The disclosed sealing mechanisms of the present invention can also be used as part of other container designs, even those that would not be directed to the storing and dispensing of paint. The structure of container 20 or either of the other two embodiments (containers 31 and 36) can be used for storing and dispensing other product, such as fine granular material which is pourable. For such materials, no further sealing would be required beyond what is illustrated for the container embodiments of FIGS. 1–2. The various sealing mechanisms of the present invention and how they can be adapted into paint container 20, into the other two paint container embodiments, or into other container designs will be described herein.

With references to FIGS. 6, 7, and 8, a second embodiment for a paint container 31 is illustrated. To begin, it should be understood that the same style of pouring spout 22 and handle 24 are used in this embodiment (container 31) and their attachment or engagement with the cap 32 and neck portion 26 are the same as that illustrated as part of paint container 20. The interior size and shape of the neck portion 26 of the FIGS. 6–8 container embodiment is substantially the same as the neck portion 26 of the FIGS. 1–5 container embodiment. As such, with the identical spout being used, the threaded engagement is the same and the surface-to-surface interference fit on the interior of the neck portion is the same.

The overall design of cap 32 is different from the overall design of cap 23, but the size, shape and arrangement of the interior of threaded outer wall 32*a* of cap 32 is virtually identical to the size, shape and arrangement of the interior of threaded outer wall 23*a* of cap 23. As such, the threaded engagement between the internal threads on the cap 32 and the upper threaded portion 27 on the spout 22 is virtually the same in paint containers 20 and 31. The differences between paint container 20 and paint container 31 are found in the shaping and contouring of contoured body 30 and in the shaping and contouring of the exterior of cap 32.

Referring first to contoured body 30, it includes recessed portion 88*a*, 88*b*, and 89. Portions 88*a* and 88*b* are similarly configured as hand gripping recesses on opposite sides of land portion 90 and are symmetrically arranged relative to centerline 91. The peripheral edges 92*a* and 92*b* of each recessed portion 88*a* and 88*b*, respectively, are smoothly contoured and curved as they extend from the base or bottom of each recessed portion upwardly and outwardly to outer surface 93 of contoured body 30.

Land portion 90, which is centered in centerline 91, is contoured and tapered along its (longitudinal) sides for easy gripping by the hand of the user. While the actual shapes of recessed portions 88*a*, 88*b*, and 89 are different from portions 46*a*, 46*b*, and 47, they are intended to function and perform in virtually the same manner. This includes recessed portion 89 which is intended to receive a product label. The same is true for land portion 90 as compared to land portion 50. While the corresponding shapes of these two land portions are slightly different, albeit in fairly minor ways, these two land portions 90 and 50 are intended to function and perform in virtually the same manner.

With regard to cap 32, it includes a generally cylindrical outer wall 32*a* which defines a series of equally spaced, recessed pockets 95 which serve as finger indents to facilitate gripping of cap 32 by the hand of the user. The raised upper portion 96 of cap 32 is generally cylindrical and cooperates with a recessed circular portion (not illustrated) in base 97 so as to enable to one (or more) paint containers 31 to be stacked by placing portion 96 of one container into portion 97 of another container.

The upper surface of the raised upper portion 96 is contoured with two recessed segment-shaped pockets 100 and 101 which are separated by dividing ridge 102. The peripheral edges 103 of each pocket 101, 102 are smoothly contoured and curved as they extend from the bottom of each pocket to the outer surface of portion 96. These two recessed pockets 100 and 101 in cooperation with the dividing ridge 102 enable the cap 32 to be grasped in an ergonomically-convenient manner so as to more easily remove the cap 32 from the spout 22 in order to open container 31 and also to more easily reapply cap 32 to spout 22 to close container 31.

With reference to FIGS. 9, 10, 11 and 12, a third embodiment for a paint container 36 is illustrated. To begin, it should be understood that virtually the same style of pouring spout 22' is used in this embodiment (container 36) and its engagement with the cap 37 and with neck portion 26 is basically the same as that illustrated for spout 22 as part of paint containers 20 and 31. The one difference between spout 22' and 22 is the elimination of pivot posts 44 from spout 22'. With regard to paint container 36, a hinged, bail-like handle is not used and thus there is no need for the handle pivot posts 44 as part of the annular collar 106. While this third preferred embodiment for a paint container includes a molded-in handle 35*a*, and thus the decision to not include a separate hinged, bail-like handle 24, spout 22' could be replaced by spout 22 if such a handle might be desired as part of the overall container 36 design. Closing cap 37 of container 36 is virtually identical to closing cap 32 of container 31.

The interior size and shape of the neck portion 26 of the FIGS. 9–12 paint container embodiment is substantially the same as the neck portion 26 of the FIGS. 1–5 and FIGS. 6–8 embodiments. As such, with virtually the identical spout being used, the threaded engagement between the cap 37 and spout 22' is the same as in the prior two embodiments using spout 22. Likewise, the threaded engagement between the spout 22' and container body 35 is the same as in the prior two embodiments. Further, the surface-to-surface interference fit on the interior between the neck portion 26 and spout inner sidewall 73 is the same as in the prior two embodiments.

As noted, the overall design of cap 37 is virtually identical to the design of cap 32. The same recessed pockets 95 are included as part of cap 37 as well as the two recessed segment-shaped pockets 100 and 101 and dividing ridge 102. The contouring of the pockets 100 and 101 is the same between cap 37 and cap 32, including the same contoured peripheral edges 103.

In addition to the removal of handle 24 from the FIGS. 9–12 embodiment of paint container 36, the most noticeable change with respect to either of the other two embodiments is the replacement of the recessed portions 46*a*, 46*b*, 88*a*, and 88*b* and replacement of the land portions 50 and 90, by the molded-in handle 35*a*. Handle 35*a* is centered on parting centerline 108 and is bounded on opposite sides by clearance spaces 109*a* and 109*b*. These clearance spaces help to provide hand clearance for the hand of the user to be able to reach around and fully grasp handle 35*a*, allowing the fingers to extend into aperture 110. The handle 35*a* clearance spaces 109*a* and 109*b* and aperture 110 are smoothly shaped and contoured for ergonomic comfort and convenience. In view of the fact that this handle 35*a* is intended to be used to lift the filled paint container 36 and to pour out paint by way of spout 22', the circumferential size of handle 35*a* is ergonomically important, as is the contoured shape, including ridge 107, in order to handle the weight and to dispense paint smoothly and in a controlled fashion.

The single recessed portion of the prior two embodiments which is designed to receive a product label has been replaced with two recessed portions 111*a* and 111*b* located symmetrically on opposite sides of centerline 108. The addition of handle 35*a* and its configuration, as part of contoured body 35, requires that for the most cost effective mold design, the mold parting line coincides with centerline 108. With this parting line, any attempt to incorporate a molded-in label would not be possible with a single, wrap-around, recessed portion for the product label, as shown in the first two embodiments, noting portions 47 and 89. In those embodiments using the referenced centerline (48 and 91, respectively) as the mold parting line would mean that the mold parting line would pass through the center of the label. Accordingly, this third embodiment for paint container 36 discloses another feature of the present invention. Specifically, this embodiment discloses the concept and structure of two separate recessed portions for product labeling which portions are on opposite sides of the mold parting line such that molded-in-place labels can be used.

The base 114 of contoured body 35 is contoured with a recessed pocket 115 which is sized and shaped to receive the raised upper portion 116 of cap 37 for achieving the stackable capability for paint container 36. The configuration of base 114 including pocket 115 and the configuration of upper portion 116 are such that the stacking of paint container 36 can be achieved in basically the same manner as achieved for the first two paint container embodiments.

Referring to FIGS. 14 and 15, the details of handle 24 and its connection to spout 22 are illustrated. In the context of handle 24 and its attachment to spout 22, FIGS. 13 and 14 illustrate the details of the pair of oppositely-disposed pivot posts 44. In the context of the description of these components, it should be understood that each of the basic structural elements that are part of each paint container described herein, including paint containers 20, 31, and 36, are molded out of plastic as unitary members. This means that each contoured body, each spout, each cap, and each separate handle, is a unitary, molded plastic member. It is intended that the selected materials will be recyclable materials. Suitable materials for the contoured body include various grades of polyethylene, ranging from medium to high-density resins. Suitable materials for the spout and cap include a high-density, injection-molding grade, polyethylene resin. Suitable materials for the handle include a low to medium density polyethylene resin.

Returning to the description of the handle 24 and pivot posts 44, it will be seen that each pivot post 44 includes an enlarged cylindrical head 125 and a concentric, reduced diameter stem 126 integrally connecting the head 125 to the outer cylindrical surface of spout 22. The cooperating handle 24 includes a wider gripping portion 127 which connects to the oppositely-disposed, open sockets 128 by more narrow, tapered portions 129. Each socket 128 is substantially cylindrical with a pivot post entry opening 130 and a part-cylindrical groove 131. The axial height or width of groove 131 in each socket 128 is sized and arranged to receive the enlarged cylindrical head 125 of the corresponding pivot post 44.

In order to initially attach handle 24 to spout 22, the preferred approach is to do so with the spout separated from the remainder of the corresponding paint container. By orienting the body of handle 24 below the spout, the handle 24 is able to snap onto the two pivot posts 44 by first positioning the sockets above the posts such that each opening 130 is aligned with its corresponding pivot post 44. Then, by pulling the handle down in the direction of the posts, the heads 125 are able to slide into the corresponding opening 130 and from there into the corresponding groove 131. The handle body is then pivoted upwardly to a generally horizontal orientation. When the spout is attached to the container body, the handle is able to rest in this horizontal orientation by actually resting on a portion of the container body. However, the handle is able to freely pivot on pivot posts 44 from its horizontal, stowed condition to a vertical, dispensing condition. In order to separate handle 24 from the pivot posts 44, the handle has to be moved so that the enlarged cylindrical head 125 of each pivot post can slide out of the receiving groove 131.

Referring to FIGS. 13 and 14, the details of spout 22 are illustrated. Included as part of spout 22 are a pouring lip 82, a brush-wiping edge 78, a brush-holding receptacle 79, and drain-back apertures in bottom wall 80. The pouring lip 82 and brush-wiping edge 78 cooperate to define interior opening 77. It should be understood that spout 22' is identical to spout 22 except for the elimination of pivot posts 44 from spout 22'. Spout 22 has a substantially annular form for ease of insertion into neck portion 26 and for the described interference fit (around the entire circumference) due to the annular form of neck portion 26. The interior opening 77 is sized to receive a paint brush for dipping the brush into the paint contained within the interior volume 81. As the paint brush is withdrawn, it can be rubbed across wiping edge 78 in order to wipe the excess paint from the brush bristles. The brush-wiping edge 78 is actually part of blade 140 which is inclined with edge 78 being the lower point. Blade 140 is of a unitary construction with the inner surface of spout 22 and separates the interior opening 77 from the brush-holding receptacle 79.

The pouring lip 82 includes a contoured center portion 82*a* in order to help center the dispensing flow of paint and control the size and location of the existing stream of paint. Bottom wall 80 is substantially flat and defines three drain-back apertures 141. These apertures 141 allow any paint that drips or runs off of the paint brush when placed or stored in the receptacle 79 to return to the interior volume 81 of the container body. As the brush is wiped across edge 78 so as to remove excess paint, it is anticipated that some excess paint will actually collect on the surface of blade 140. Due to the inclined nature of blade 140 which is directed toward interior opening 77, any excess paint that collects on the surface of blade 140 is able to run down and back into the interior volume 81 by way of interior opening 77. If the volume of paint being collected on blade 140 is such that some of the paint actually cascades over the opposite edge of blade 140 into receptacle 79, this excess paint is also able to return to the interior volume 81 by way of drain-back apertures 141. By locating posts 44 in a location which is axially close to pouring lip 82 and in particular portion 82*a*, an improved balance for container 20 is achieved and this helps to smoothly dispense paint from container 20 by tilting and pouring.

As explained herein, it is contemplated, as part of the present invention, that one or more sealing mechanisms or structures will be arranged as part of paint containers 20, 31, and 36. Since these sealing mechanisms according to the present invention have a broad application to other types of containers and for sealing an interface between two or more members, they are described in a more generic manner. In the context of the present invention, the locations within paint containers 20, 31, and 36 where one or more of the sealing mechanisms can be utilized are identified. Any minor details of exactly how to configure the two (or more) cooperating sealing portions of the two (or more) interface members in the context of the three paint container embodiments should be clear to one of ordinary skill in the art.

Continuing with the description of the various sealing structures or mechanisms of the present invention, reference will be made to FIGS. 16–25.

Figure 16:
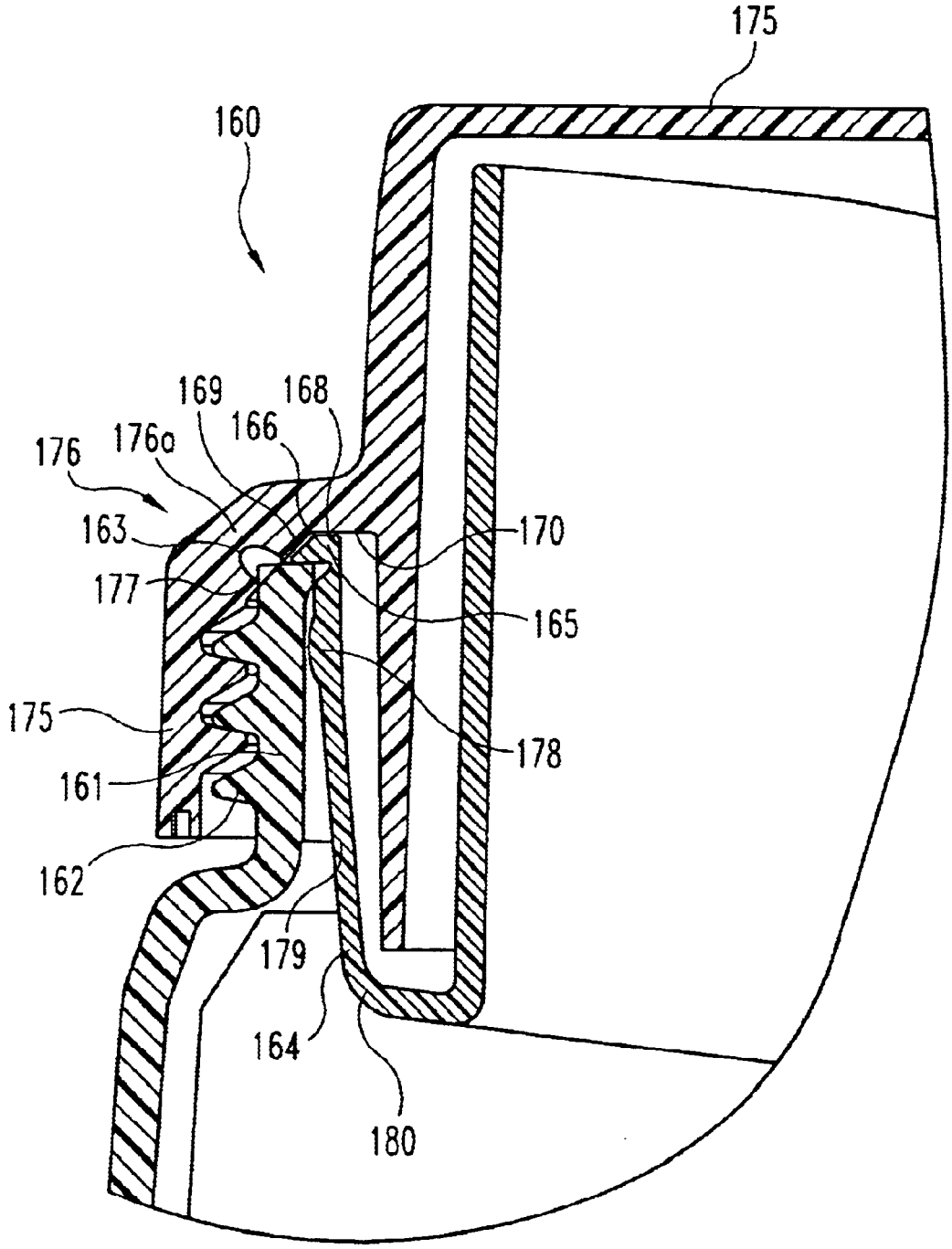
FIG. 16 is a partial, side elevational view, in full section, of a sealing mechanism for use with a container according to one embodiment of the present invention.

Referring first to FIG. 16, there is illustrated sealing mechanism 160 which includes an annular container neck finish 161 fabricated from a mono block tool design with buttress threads 162 and squared, annular land area 163 at the upper surface. An integrated spout 164 includes an outer radial projection 165 which rests on the inside edge of the land area 163. The upper land portion 166 of the spout is angled to allow minimal clearance between the spout outer surfaces of upper land portions 166 and 168 and the inside cap surfaces 169 and 170, respectively. The cap 175 includes an outer collar 176 with an angled portion 176*a* which, when tightened onto a container (via surface 169), contacts the outer, upper edge 177 of the upper land area 163 with surface-to-surface interference. Sealing is achieved by deforming the upper edge 177 of land area 163 at an angle of between approximately 15 and 85 degrees. This may be accomplished either with a single angled surface or with a compound angled surface. As deformation continues to increase following multiple uses, the spout 164 is compressed onto the upper, annular land area 163 of the container, thereby providing additional sealing. The spout 164 also serves to provide structural support for the corresponding container by preventing collapse of the neck as the cap is tightened. The spout is retained in the container by a small raised rib 178, which may preferably be either solid or segmented, located on the outer surface 179 of wall 180 below the radial projection 165. The combination of materials between cap 175 and container neck 161 is such that one component has a lower modulus of elasticity relative to the other. This difference permits material deformation more readily of the component with the lower modulus in order to achieve sealing.

Figure 17:
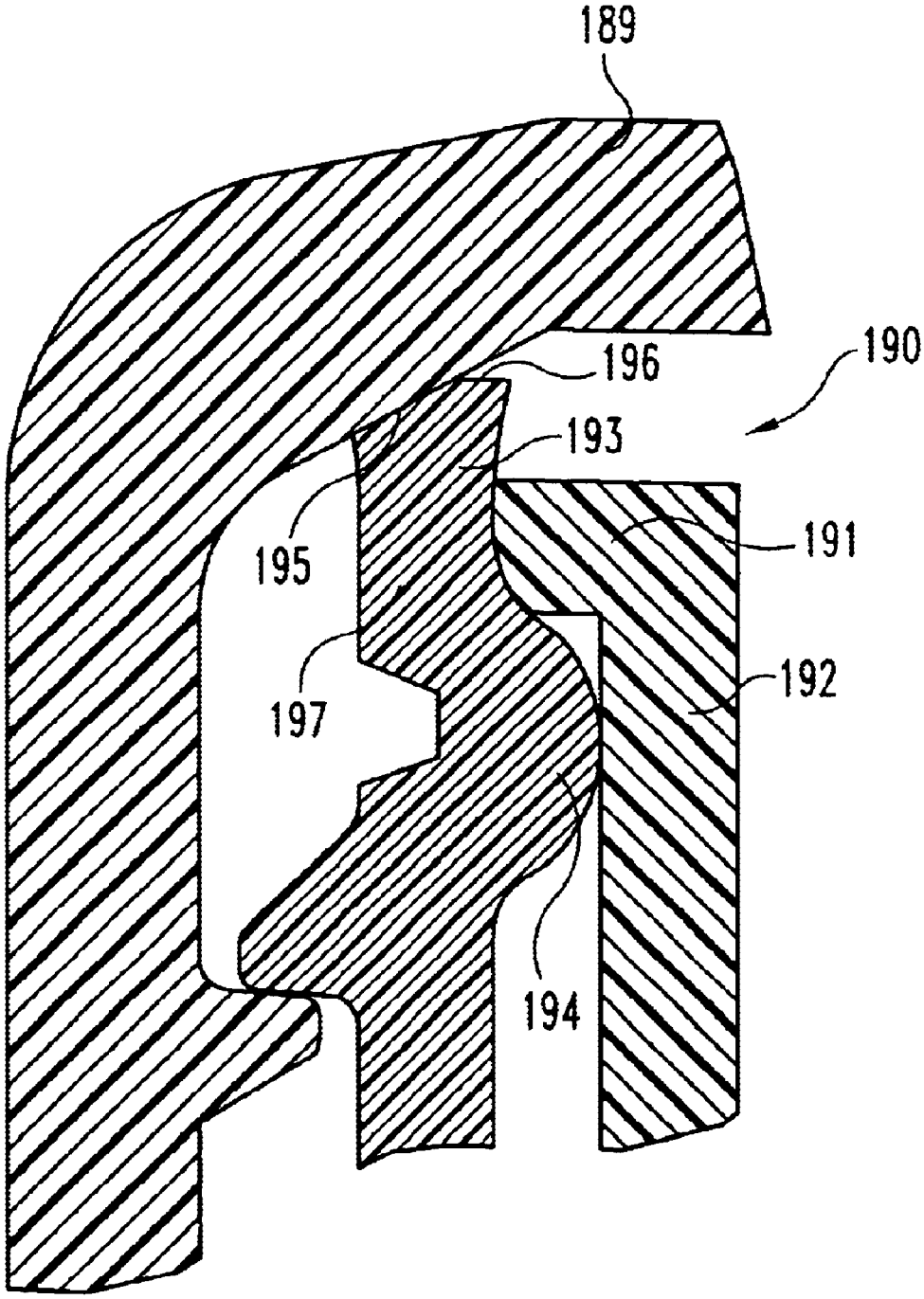
FIG. 17 is a partial, side elevational view, in full section, of a sealing mechanism for use with a container according to another embodiment of the present invention.

Referring to FIG. 17, sealing mechanism 190 is illustrated. Sealing mechanism 190, which includes cap 189, spout 192, and annular container neck 193, is similar in certain respects to sealing mechanism 160. One difference between these two designs relates to the fact that the radial lip 191 of the spout 192 is located below the upper surface 196 of the container neck 193 and is retained by a raised rib 194 formed by a choker ring from the mono block tool design. Sealing is achieved by deforming the upper outer edge 195 at an angle of between approximately 15 and 85 degrees, either with a single angled surface as part of cap 189 or with a compound angled surface. By locating the spout 192 (including lip 191) below the upper surface 196 of the container neck 193, radial deformation of the container neck is permitted and provides a means of conforming to inconsistent surfaces and ovality.

Figure 18:
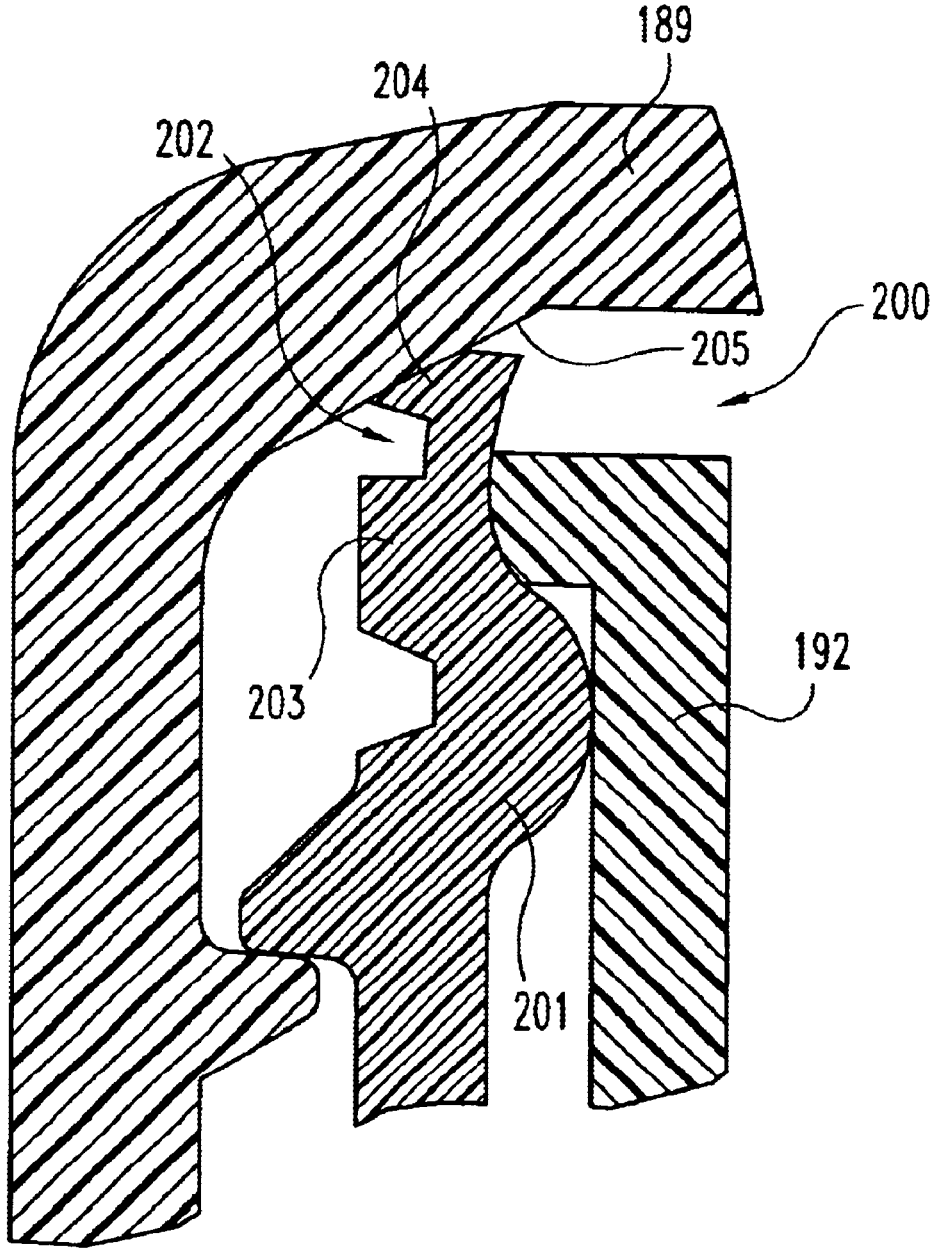
FIG. 18 is a partial, side elevational view, in full section, of a sealing mechanism for use with a container according to another embodiment of the present invention.

Referring to FIG. 18, there is illustrated a sealing mechanism 200 which has similarity to sealing mechanism 190. Sealing mechanism 200 includes cap 189, spout 192, and annular container neck 201. Container neck 201 is designed with an annular undercut groove 202 formed into the outer surface 203 of the container neck finish 201. The undercut groove 202 forms a more conforming and flexible sealing lip 204 to the angled surface 205 of the cap 189. This sealing mechanism 200 would preferably require the spout 192 to be located below the upper surface of the container neck finish 201.

Figure 19:
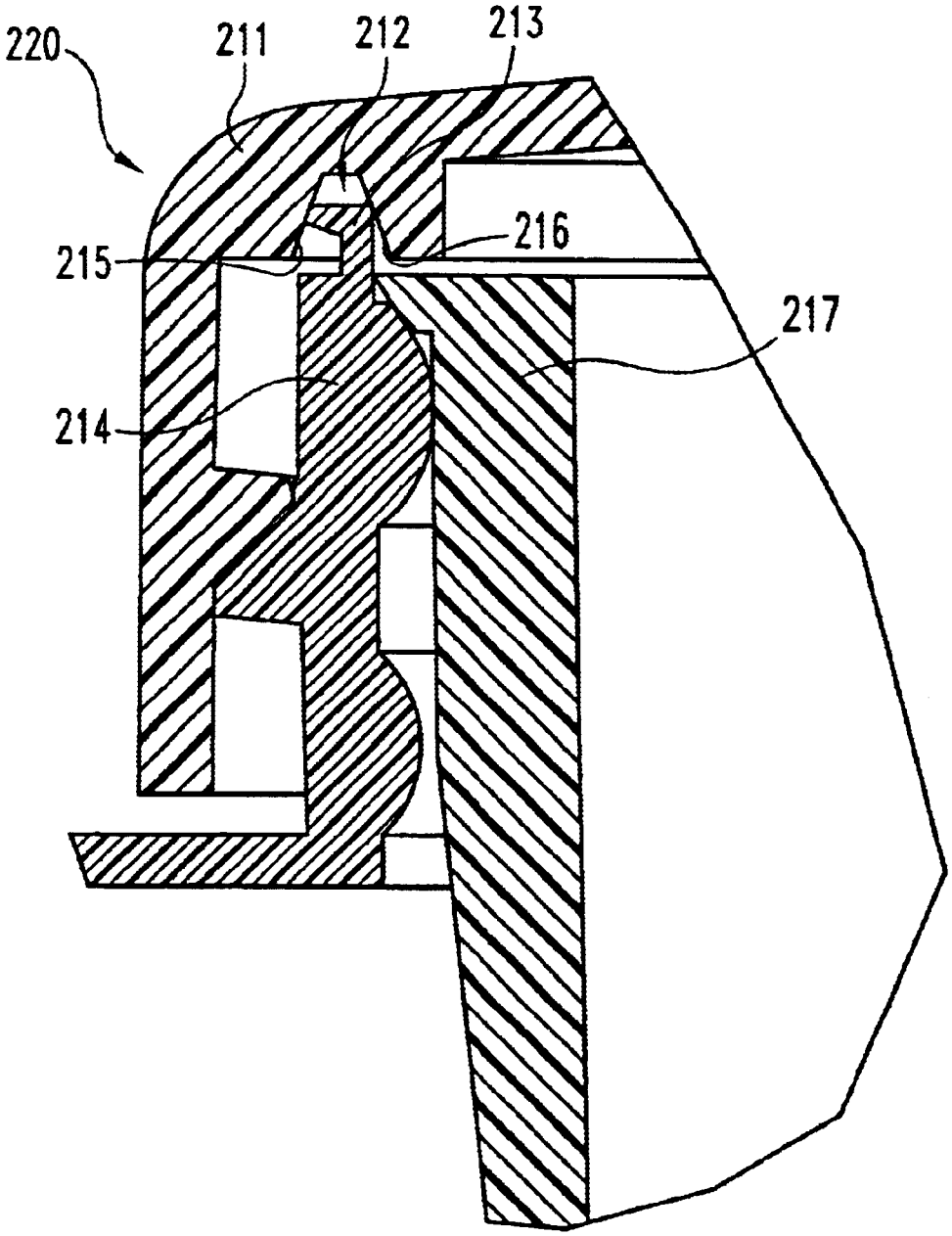
FIG. 19 is a partial, side elevational view, in full section, of a sealing mechanism for use with a container according to another embodiment of the present invention.

Referring to FIG. 19, there is illustrated sealing mechanism 210 which is similar to what is illustrated in FIG. 18 for sealing mechanism 200. Sealing mechanism 210 includes a cap 211 with an angled groove 212 therein which is provided to locate and form multiple sealing edges with container neck 214. Sealing is achieved by wedging the upper lip portion 213 of the container neck 214 into a groove 212 which is located generally at the same diameter as that of container neck 214. The groove 212 is designed with angled side walls 215 and 216, allowing optimal engagement and compression to the lip portion 213 of container neck 214 within the desired rotation and axial travel of caps 211. The spout 217 has a design which is substantially the same as spout 192.

Figure 20:
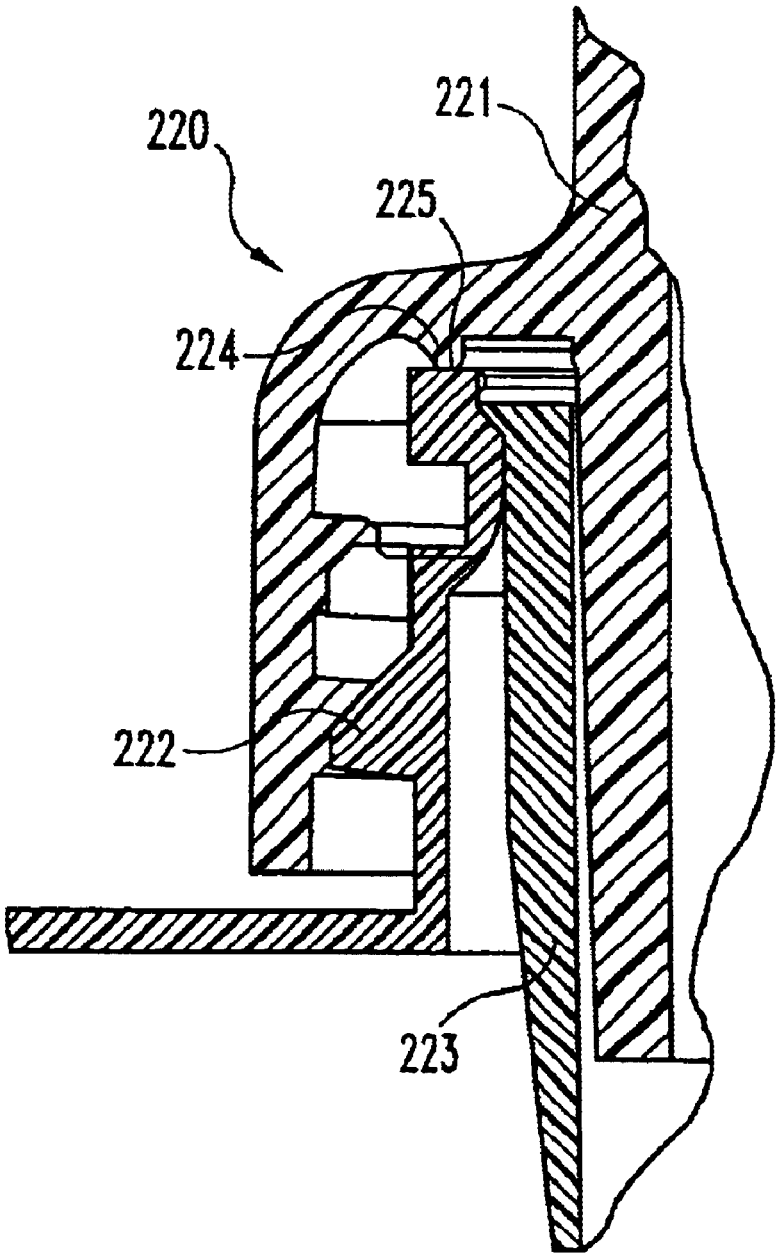
FIG. 20 is a partial, side elevational view, in full section, of a sealing mechanism for use with a container according to another embodiment of the present invention.

Referring to FIG. 20, there is illustrated sealing mechanism 220 which includes closing cap 221, annular container neck 222, and spout 223. Sealing mechanism 220 further includes a flexible, annular lip 224 (or alternatively a plurality of annular lips) as part of cap 221. The flexible lip 224 is oriented in a slanting, inward direction and is constructed and arranged so as to sealingly contact the upper land surface 225 of the container neck 222. The flexible lip 224 is constructed and arranged to deform as the cap 221 is tightened onto the container neck, forming a concentrated sealing force applied onto the upper land surface 225.

Figure 21:
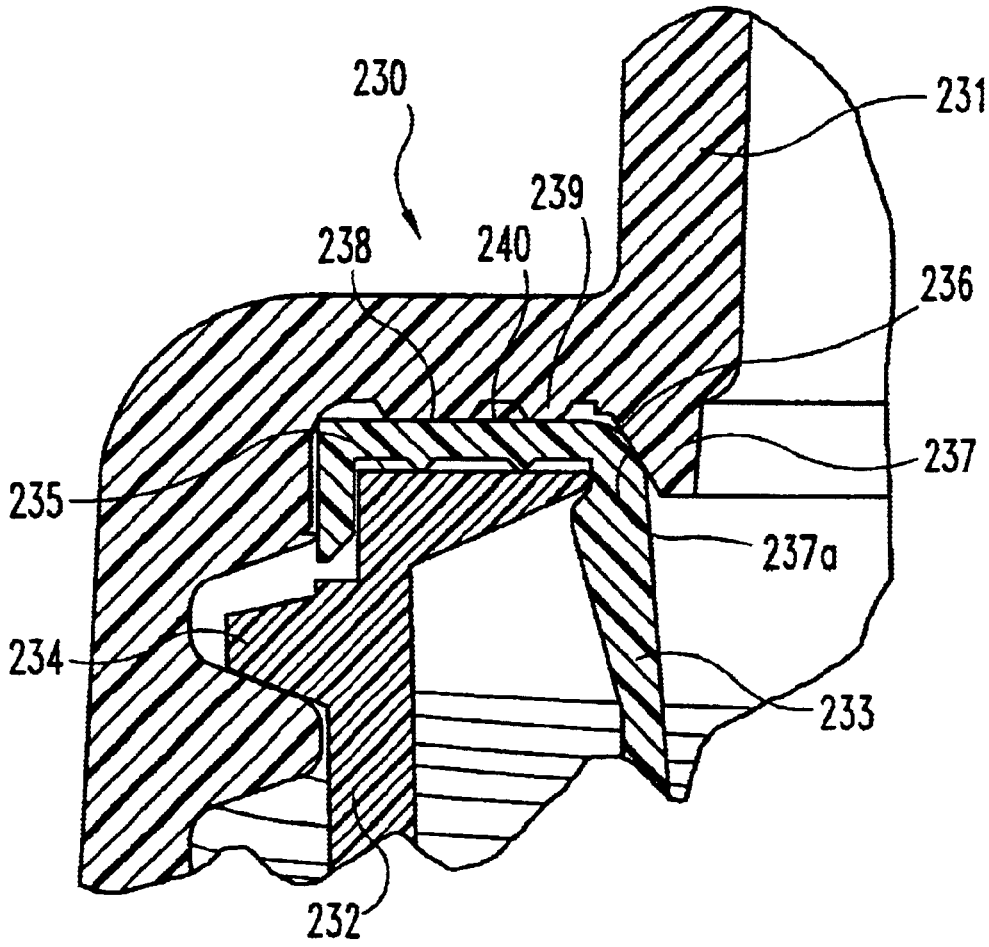
FIG. 21 is a partial, side elevational view, in full section, of a sealing mechanism for use with a container according to another embodiment of the present invention.

Referring to FIG. 21, there is illustrated sealing mechanism 230 which includes closing cap 231, annular container neck 232, and spout 233. The uniform container neck finish 232 is formed from a mono block tool design with buttress threads 234 and squared, annular land area 235 at the upper surface. The integrated spout 233 is constructed and arranged to cover the upper surface of land area 235 of the container neck 232. Cap 231 includes an inner angled surface 237*a* on annular protrusion 237 which, when tightened onto a container, creates contact with the inner edge 236 of the spout. Sealing is achieved by means of short flat land seals 238 and 239 which make contact with the upper surface 240 of the spout 233. The cap has an inner angled surface 237*a* which deforms the inner edge 236 of the spout and container to form a complying sealing surface at that interface. Spout 233 is preferably made from a material having a lower modulus of elasticity than that of annular protrusion 237 so as to bias sealing deflection into the spout. There are though cases when annular protrusion 237 is preferred to be biased and create sealing through deformation using a lower modulus material than that of spout 233.

Figure 22:
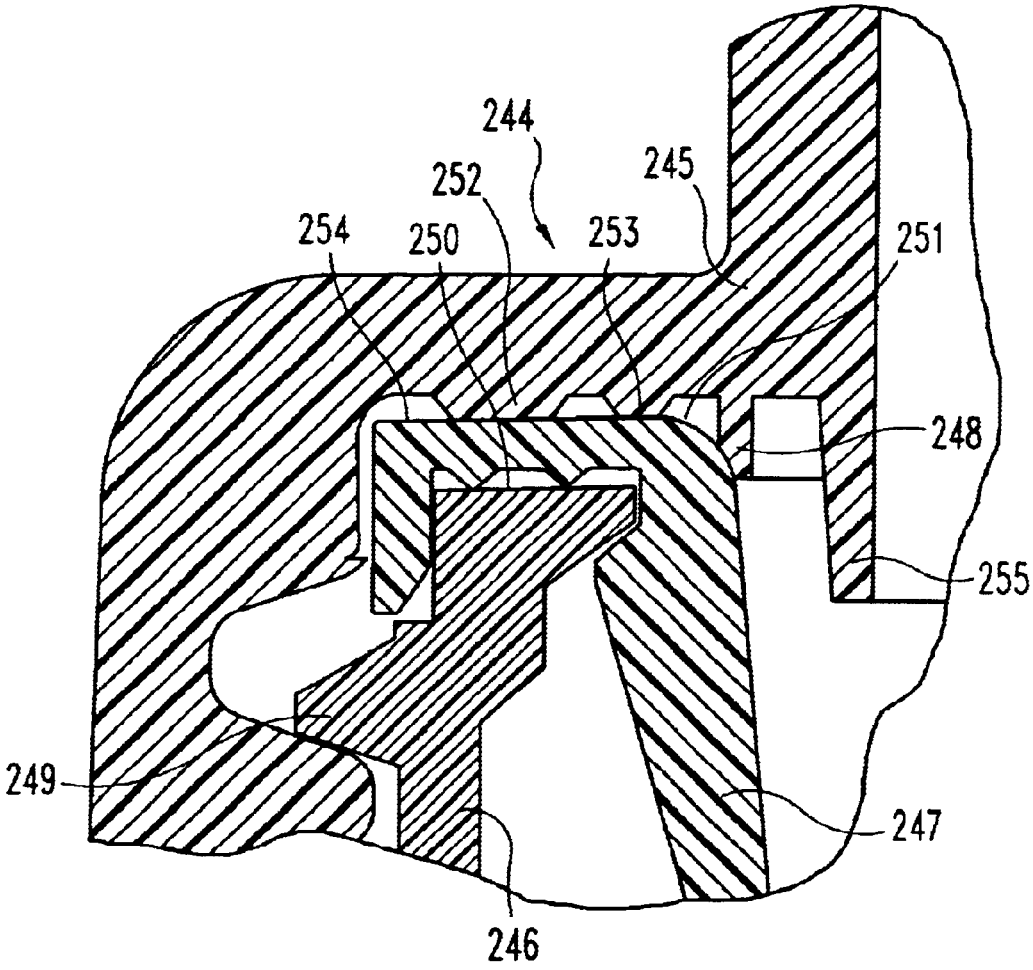
FIG. 22 is a partial, side elevational view, in full section, of a sealing mechanism for use with a container according to another embodiment of the present invention.

Referring to FIG. 22, there is illustrated sealing mechanism 244 which includes closing cap 245, annular container neck 246, and spout 247. Sealing mechanism 244, which has a number of similarities to sealing mechanism 230, further includes a flexible, annular member 248 which acts as a secondary seal and replaces the inner annular protrusion 237. Container neck 246 includes a uniform container neck finish fabricated from a mono block tool design with buttress threads 249 and squared land area 250 at the upper surface. Spout 247 is constructed and arranged to cover the upper surface of the container neck. The flexible member 248 protrudes downward from the deck of the cap which, when tightened onto a container, yields contact with the inner surface 251 of the spout. Sealing is achieved by means of short, flat land seals 252 and 253 which make contact with the upper surface 254 of the spout and from the flexible member 248 in contact with the spout. An additional, axially protruding, annular member 255 is located radially inwardly of the flexible member 248 and extends axially below the flexible member 248. This additional member 255 provides protection (preventing damage) for the flexible member 248 during manufacturing, handling, and shipping and assembly. Means for preventing spout rotation may be employed with this sealing mechanism design. Member 255 also provides a product baffle or shield that limits direct product influence when being shaken vigorously.

Figure 23:
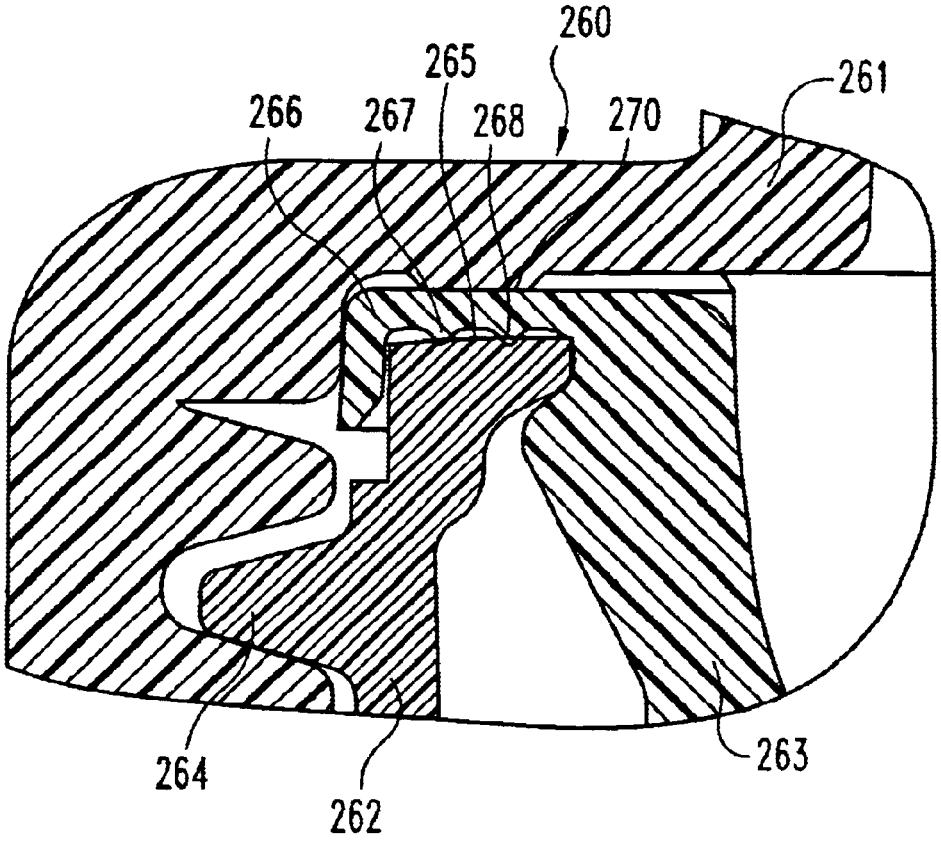
FIG. 23 is a partial, side elevational view, in full section, of a sealing mechanism for use with a container according to another embodiment of the present invention.

Referring to FIG. 23, there is illustrated sealing mechanism 260 which includes closing cap 261, annular container neck 262, and spout 263. The container neck 262 of sealing mechanism 260 includes a uniform neck finish fabricated from a mono block tool design with buttress threads 264 and squared, land area 265 at the upper surface. The spout 263 is constructed and arranged to cover the upper land area 265 of the container neck 262. The cap 261 extends over and around spout 263 and thus the outer radial collar 266 of the spout is sandwiched between the neck 262 and cap 261. Sealing is achieved by means of tapered and projecting land seals 267 and 268 which are in the form of "V"-beads and which make contact with the land area 265 of the spout. The cap 261 will also seal to the spout by means of flat, land seal 270. The preferred embodiment is to have the "V"-beads 267 and 268 of a softer material so as to achieve deformation and provide sealing relative to container neck 262.

Figure 24:
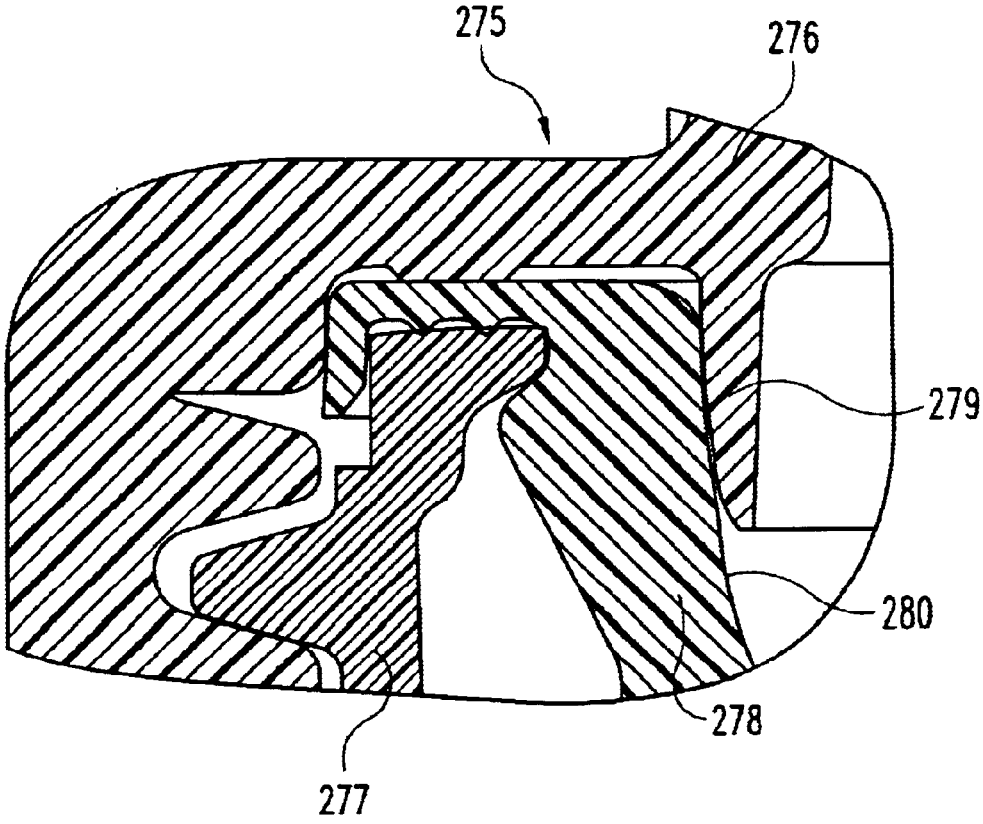
FIG. 24 is a partial, side elevational view, in full section, of a sealing mechanism for use with a container according to another embodiment of the present invention.

Referring to FIG. 24, there is illustrated sealing mechanism 275 which includes closing cap 276, annular container neck 277, and spout 278. Sealing mechanism 275 is similar to sealing mechanism 260 with the lone exception of including flexible member 279 protruding downwardly from the deck of cap 276. Member 279 is used to establish a sealed interface against the inner surface 280 of spout 278. As the cap is tightened onto the neck 277 of the container, the size, shape and location of member 279 relative to the spout causes member 279 to deflect due to the interference which is experienced and this in turn creates a contact seal.

Figure 25:
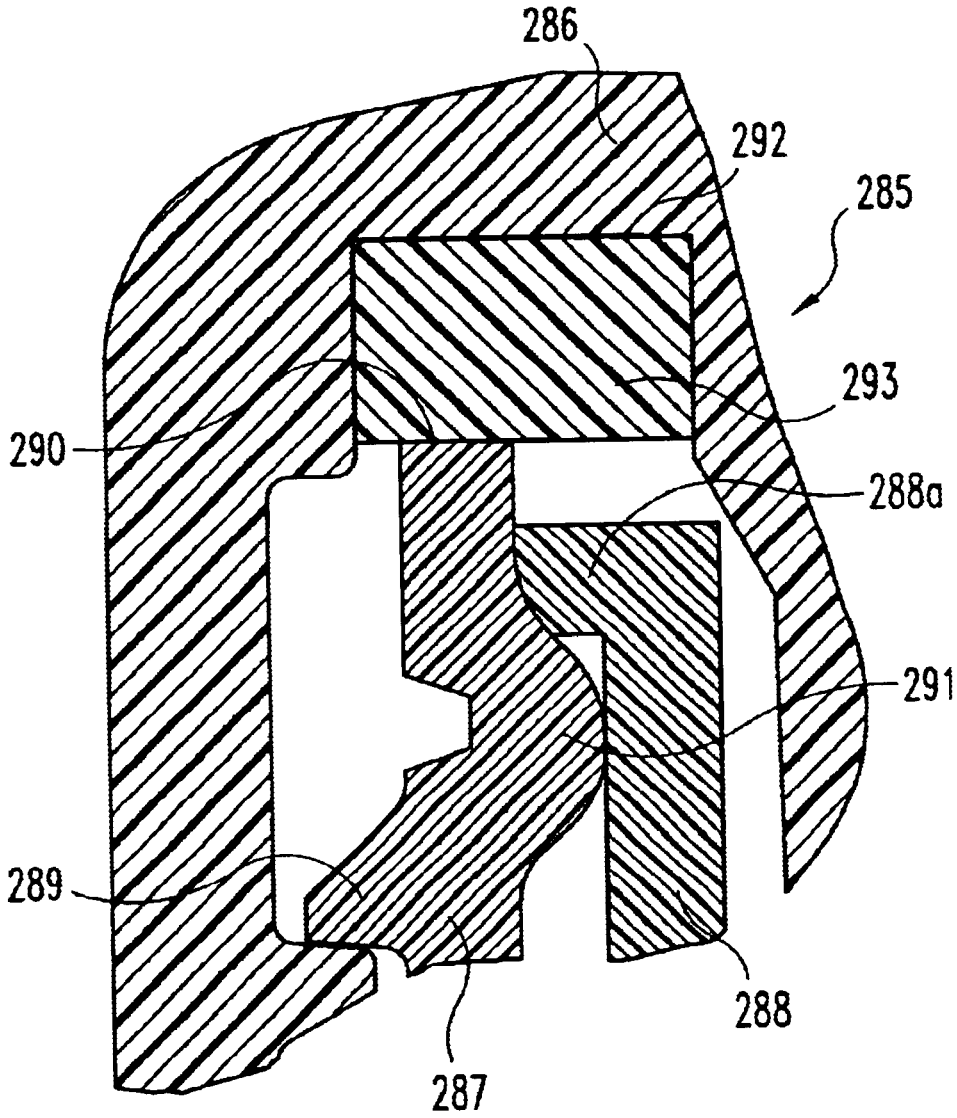
FIG. 25 is a partial, side elevational view, in full section, of a sealing mechanism for use with a container according to another embodiment of the present invention.

Referring to FIG. 25, there is illustrated sealing mechanism 285 which includes closing cap 286, annular container neck 287, and spout 288. The container neck 287 includes a uniform bottle neck finish fabricated from a mono block tool design with buttress threads 289 and squared land area 280 at the upper surface. The spout 288 includes a radial lip 288*a* which is located below the upper surface 290 of the container neck and is retained by raised rib 291 formed by a choker ring from the mono block tool design. The upper inside surface of the cap includes (and defines) and annular groove 292 which receives a flexible, annular, square-cut gasket 293. Alternatively the gasket 293 shape could be round in lateral section or O-ring shaped. Sealing is achieved by means of compressing the gasket 293 against the upper surface 290 of the container neck in order to form a complying sealing surface at reduced torque amounts over other sealing means. The key to effective sealing is to select a gasket material which is compliant relative to sealing surface 290.

The sealing mechanisms disclosed as part of the present invention (see FIGS. 16–25) 25) are illustrated, in one general application, as they can be used for sealing an interface or interfaces between two or more structural members. As should be understood, the structural members selected as one means to describe the specifics of each sealing mechanism include a container body with a threaded neck portion, a pouring spout inserted into the neck portion, and a removable closing cap which is threadedly attachable to the container neck portion. However, one or more of the disclosed sealing mechanisms can also be used as part of other container configurations, including the paint container embodiments of FIGS. 1–15, as one example of other compatible container configurations which are suitable to be configured with one or more of the disclosed sealing mechanisms.

As one example of how one or more of the sealing mechanisms disclosed herein can be adapted for use with one of the disclosed paint container embodiments, consider the sealing mechanism 210 of FIG. 19. If we consider only the cap 211 and the container neck 214, these two structural members have a wedge-type seal between lip portion 213 and groove 212. This type of sealing mechanism could be used in paint container 20 by shaping cap 23 with groove 212 and spout 22 with lip portion 213. In addition, or alternatively, this type of sealing mechanism could be used in paint container 20 by shaping spout 22 with groove 212 and the container neck portion 26 with lip portion 213.

The sealing mechanism 220 of FIG. 20 can also be adapted for use with paint container 20. In this arrangement, one location for sealing is between the cap 23 and the upper edge (land area) of spout 22. In order to incorporate the design principles of sealing mechanism 220, the cap 23 needs to be shaped so as to include flexible lip 224. In addition or alternatively, another location for sealing is between the spout 22 and the top edge (land area) 63 of neck portion 26.

In a similar manner, the sealing mechanism 230 of FIG. 21 can be adapted to be incorporated into paint container 20 at the location between the upper edge of the spout 22 and cap 23. The improvement of sealing mechanism 244 of FIG. 22 in the form of protective member 255 can be included as part of the modification of paint container 20 in order to incorporate this sealing mechanism.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A sealing mechanism for a container for sealing an interface between a plurality of structural members, said sealing mechanism comprising:

a first member having a neck portion defining an opening;

a second member positioned in contact with said first member and having an inner annular edge; and a removable third member attachable to said first member for closing said opening and including a downwardly projecting, flexible protrusion which is constructed and arranged to seal against said inner annular edge when said third member is attached to said first member, said third member including a projecting land seal which seals against said second member when said third member is attached to said first member and a protective member radially inwardly of said flexible protrusion.

2. The sealing mechanism of claim 1 wherein said flexible protrusion is substantially annular in shape and said protective member is substantially annular in shape.

3. A sealing mechanism for a container for sealing an interface between a plurality of structural members, said sealing mechanism comprising:

a first member having a neck portion defining an opening;

a second member positioned in contact with said first member and having an inner annular edge; and a removable third member attachable to said first member for closing said opening and including a downwardly projecting, flexible protrusion which is constructed and arranged to seal against said inner annular edge when said third member is attached to said first member, said third member including a protective member radially inwardly of said flexible protrusion.

4. The sealing mechanism of claim 3 wherein said flexible protrusion is substantially annular in shape and said protective member is substantially annular in shape.

* * * * *

UNITED STATES PATENT AND TRADEMARK OFFICE

CERTIFICATE OF CORRECTION

PATENT NO. : 6,843,389 B2
DATED : January 18, 2005
INVENTOR(S) : Kasting et al.

It is certified that error appears in the above-identified patent and that said Letters Patent is hereby corrected as shown below:

Column 17,
Line 6, delete the second instance of "25)".

Signed and Sealed this

Fourth Day of October, 2005

JON W. DUDAS
*Director of the United States Patent and Trademark Office*